US006160492A

United States Patent [19]

Herman

[11] Patent Number: 6,160,492

[45] **Date of Patent: *Dec. 12, 2000**

[54] THROUGH FORMATION ELECTROMAGNETIC TELEMETRY SYSTEM AND METHOD FOR USE OF THE SAME

[75] Inventor: Paul I. Herman, Plano, Tex.

[73] Assignee: Halliburton Energy Services, Inc., Dallas, Tex.

[ * ] Notice: This patent is subject to a terminal disclaimer.

[21] Appl. No.: 09/118,028

[22] Filed: Jul. 17, 1998

[51] Int. Cl.[7] ..... G01V 3/00

[52] U.S. Cl. ..... 340/854.6; 340/853.7; 340/854.8; 166/53; 166/373; 367/82

[58] Field of Search ..... 340/854.6, 853.7, 340/854.8; 166/250.15, 66, 373, 53; 324/338, 339; 702/6; 367/82

[56] References Cited

U.S. PATENT DOCUMENTS

| | | | |
|---|---|---|---|
| 3,186,222 | 6/1965 | Martin | 73/151 |
| 3,333,239 | 7/1967 | Silverman | 340/18 |
| 4,293,937 | 10/1981 | Sharp et al. | 367/82 |
| 4,348,672 | 9/1982 | Givier | 340/854 |
| 4,387,372 | 6/1983 | Smith et al. | 340/854 |
| 4,468,665 | 8/1984 | Thawley et al. | 340/856 |
| 4,496,174 | 1/1985 | McDonald et al. | 285/53 |
| 4,525,715 | 6/1985 | Smith | 340/854 |
| 4,617,960 | 10/1986 | More | 137/554 |
| 4,684,946 | 8/1987 | Issenmann | 340/855 |
| 4,691,203 | 9/1987 | Rubin et al. | 340/856 |
| 4,725,837 | 2/1988 | Rubin | 340/855 |
| 4,736,791 | 4/1988 | Rorden et al. | 166/66.4 |
| 4,796,708 | 1/1989 | Lembcke | 166/386 |
| 4,913,168 | 4/1990 | Upchurch | 166/250 |
| 4,933,640 | 6/1990 | Kuckes | 324/339 |
| 4,953,616 | 9/1990 | Borden et al. | 166/66.4 |
| 5,130,706 | 7/1992 | Van Steenwyk | 340/854.6 |
| 5,226,494 | 7/1993 | Rubbo et al. | 166/250 |
| 5,358,035 | 10/1994 | Grudzinski | 166/53 |
| 5,412,568 | 5/1995 | Schultz | 364/422 |
| 5,531,270 | 7/1996 | Fletcher et al. | 166/53 |
| 5,558,153 | 9/1996 | Holcombe et al. | 166/373 |
| 5,662,165 | 9/1997 | Tubel et al. | 166/250.01 |
| 5,706,896 | 1/1998 | Tubel et al. | 166/313 |
| 6,075,462 | 6/2000 | Smith | 340/854.6 |

FOREIGN PATENT DOCUMENTS 2 317 406 3/1998 United Kingdom .

*Primary Examiner*—Michael Horabik
*Assistant Examiner*—Albert K. Wong
*Attorney, Agent, or Firm*—Paul I. Herman; Lawrence R. Youst

[57] ABSTRACT

An electromagnetic telemetry system for changing the operational state of a downhole device (84) disclose. The system comprises an electromagnetic transmitter (76) disposed in a first wellbore (30) that transmits a command signal. An electromagnetic repeater (68) disposed in a second wellbore (38) receives the command signal and retransmits the command signal to an electromagnetic receiver (96) disposed in a third wellbore (46) that is remote from the first wellbore (30). The electromagnetic receiver (96) is operably connected to the downhole device (84) such that the command signal received from the electromagnetic repeater (68) is used to prompt the downhole device (84) to change operational states.

42 Claims, 12 Drawing Sheets

THROUGH FORMATION ELECTROMAGNETIC TELEMETRY SYSTEM AND METHOD FOR USE OF THE SAME

TECHNICAL FIELD OF THE INVENTION

This invention relates in general to downhole telemetry and, in particular to, a through formation electromagnetic telemetry system and method for communicating signals between downhole locations throughout an oil or gas field utilizing an electromagnetic repeater to amplify and retransmit the signals.

BACKGROUND OF THE INVENTION

Without limiting the scope of the invention, its background is described in connection with communication between surface equipment and downhole devices during hydrocarbon production, as an example. It should be noted that the principles of the present invention are applicable not only during production, but throughout the life of a wellbore including, but not limited to, during drilling, logging, testing and completing the wellbore.

Heretofore, in this field, a variety of communication and transmission techniques have been attempted to provide real time communication between surface equipment and downhole devices. The utilization of real time data transmission provides substantial benefits during the production of hydrocarbons from a field. For example, monitoring of downhole conditions allows for an immediate response to potential well problems including production of water or sand.

One such communication technique involves the use of a hard wire system that provides a direct communication link between surface equipment and downhole devices. These systems may, for example, utilize a single surface installation on an offshore production platform connected to each of the hard wires that extend into each well. Thus, for a platform operating sixteen wells, sixteen separate hard wire connections are required. While these systems are very reliable, it has been found that the cost associated with the implementation of hard wire systems is prohibitively expensive. It has also been found that separate surface installations are typically required for each platform in a multi-platform field.

Another technique used to communicate between surface equipment and downhole devices is through the generation and propagation of electromagnetic waves. These waves are produced by inducing an axial current into, for example, the production casing. This current produces the electromagnetic waves that include an electric field and a magnetic field, which are formed at right angles to each other. The axial current impressed on the casing is modulated with data causing the electric and magnetic fields to expand and collapse thereby allowing the data to propagate and be intercepted by a receiving system.

As with any communication system, the intensity of the electromagnetic waves is directly related to the distance of transmission. As a result, the greater the distance of transmission, the greater the loss of power and hence the weaker the received signal. Additionally, downhole electromagnetic telemetry systems must transmit the electromagnetic waves through the earth's strata. In free air, the loss is fairly constant and predictable. When transmitting through the earth's strata, however, the amount of signal received is dependent upon the skin depth ($\delta$) of the media through which the electromagnetic waves travel.

Skin depth is defined as the distance at which the power from a downhole signal will attenuate by a factor of 8.69 db (approximately 7 times decrease from the initial power input), and is primarily dependent upon the frequency (f) of the transmission and the conductivity ($\sigma$) of the media through which the electromagnetic waves are propagating. For example, at a frequency of 10 hz and a conductance of 1 mho/meter (1 ohm-meter), the skin depth would be 159 meters (522 feet) Therefore, for each 522 feet in a consistent 1 mho/meter media, an 8.69 db loss occurs. Skin depth may be calculated using the following equation.

$$\text{Skin Depth}=\delta=1/\sqrt{(\pi f \mu \sigma)} \text{ where:}$$

$\pi$=3.1417;

f=frequency (hz);

$\mu$=permeability ($4\pi\times10^{6}$); and $\sigma$=conductance (mhos/meter).

As should be apparent, the higher the conductance of the transmission media, the lower the frequency must be to achieve the same transmission distance. Likewise, the lower the frequency, the greater the distance of transmission with the same amount of power.

A typical electromagnetic telemetry system that transmits vertically through the earth's strata may successfully propagate through ten (10) skin depths. In the example above, for a skin depth of 522 feet, the total transmission and successful reception depth would only be 5,220 feet. It has been found, however, that when transmitting horizontally through a single or limited number of strata, the vagaries of the strata are small and the media more conductivity consistent which allows for a greater distance of transmission.

Therefore, a need has arisen for a downhole telemetry system that is capable of communicating real time information over a great distance between downhole devices disposed in multiple wellbores using horizontal transmission through a single or limited number of strata. A need has also arisen for a cost effective system that is capable of communicating the information between the downhole devices and the surface. Further, a need has arisen for a system that uses electromagnetic waves to transmit real time information between downhole devices through a single or limited number of strata and that uses electrical signals to transmit the information between a single downhole device and the surface.

SUMMARY OF THE INVENTION

The present invention disclosed herein comprises a downhole telemetry system and methods for use of the same that are capable of transmitting real time information over a great distance between remotely located downhole devices and between downhole devices and the surface. The system is cost effective and utilizes electromagnetic waves traveling through a single or limited number of strata to transmit real time information between downhole devices and uses electrical signals to transmit the real time information between a single downhole device and the surface.

The downhole telemetry system of the present invention may be used, for example, for changing the operational state of a downhole device. In this embodiment, the system comprises an electromagnetic transmitter disposed in a first wellbore that transmits a command signal. The command signal is received by an electromagnetic repeater disposed in a second wellbore. The electromagnetic repeater processes and retransmits the command signal. An electromagnetic receiver disposed in a third wellbore that is remote from the first wellbore, receives the command signal. The command signal is then converted to a driver signal that is used to prompt the downhole device to change operational states.

The system includes a surface installation that generated the command signal for the electromagnetic transmitter. An electrical wire may be used to connect the surface installation to the electromagnetic transmitter. The electromagnetic transmitter, the electromagnetic repeater and the electromagnetic receiver may each comprises a magnetically permeable annular core, a plurality of primary electrical conductor windings wrapped axially around the annular core and a plurality of secondary electrical conductor windings wrapped axially around the annular core.

In addition, the system may include an electromagnetic transmitter disposed in the third wellbore for transmitting a verification signal to indicate that the change in operational states of the downhole device has occurred. In this case, the system will also include an electromagnetic receiver disposed in the first wellbore for receiving the verification signal.

The command signal may include a command sequence that is uniquely associated with a specific downhole device such that the command signal will only operate the intended downhole device. In this case, an electronics package associated with each electromagnetic receiver determines whether the command sequence is uniquely associated with the downhole device associated with that electromagnetic receiver.

In one method of the present invention, the operation state of a downhole device is changed by transmitting a command signal from an electromagnetic transmitter disposed in a first wellbore, receiving the command signal at an electromagnetic repeater disposed in a second wellbore, retransmitting the command signal from the electromagnetic repeater, receiving the command signal at an electromagnetic receiver disposed in a third wellbore that is remote from the first wellbore and generating a driver signal in response to the command signal that changes the operational state of the downhole device.

In another method of the present invention, signals are transmitted from a first wellbore to a remote wellbore by transmitting a signal from a transmitter disposed in the first wellbore, receiving the signal at a repeater disposed in a second wellbore, retransmitting the signal from the repeater and receiving the signal at a receiver disposed in the remote wellbore. In this method, the signal from the transmitter to the repeater may be in the form of electromagnetic waves. Likewise, the signal from the repeater to the receiver may be in the form of electromagnetic waves.

In yet another method of the present invention, signals are transmitted throughout a hydrocarbon field by transmitting a signal from a transmitter disposed in a primary wellbore, receiving the signal with one or more stage one repeater disposed in other wellbores, retransmitting the signal from the stage one repeaters and receiving the signal at a receiver disposed in a remote wellbore. In this manner, a failure by one of the repeaters will not hinder the transmission of the signal. This method may also include receiving the signal by one or more stage two or higher repeaters. The higher stage repeater further extend the possible transmission distance of the signal such that all downhole devices in a field may be operated.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
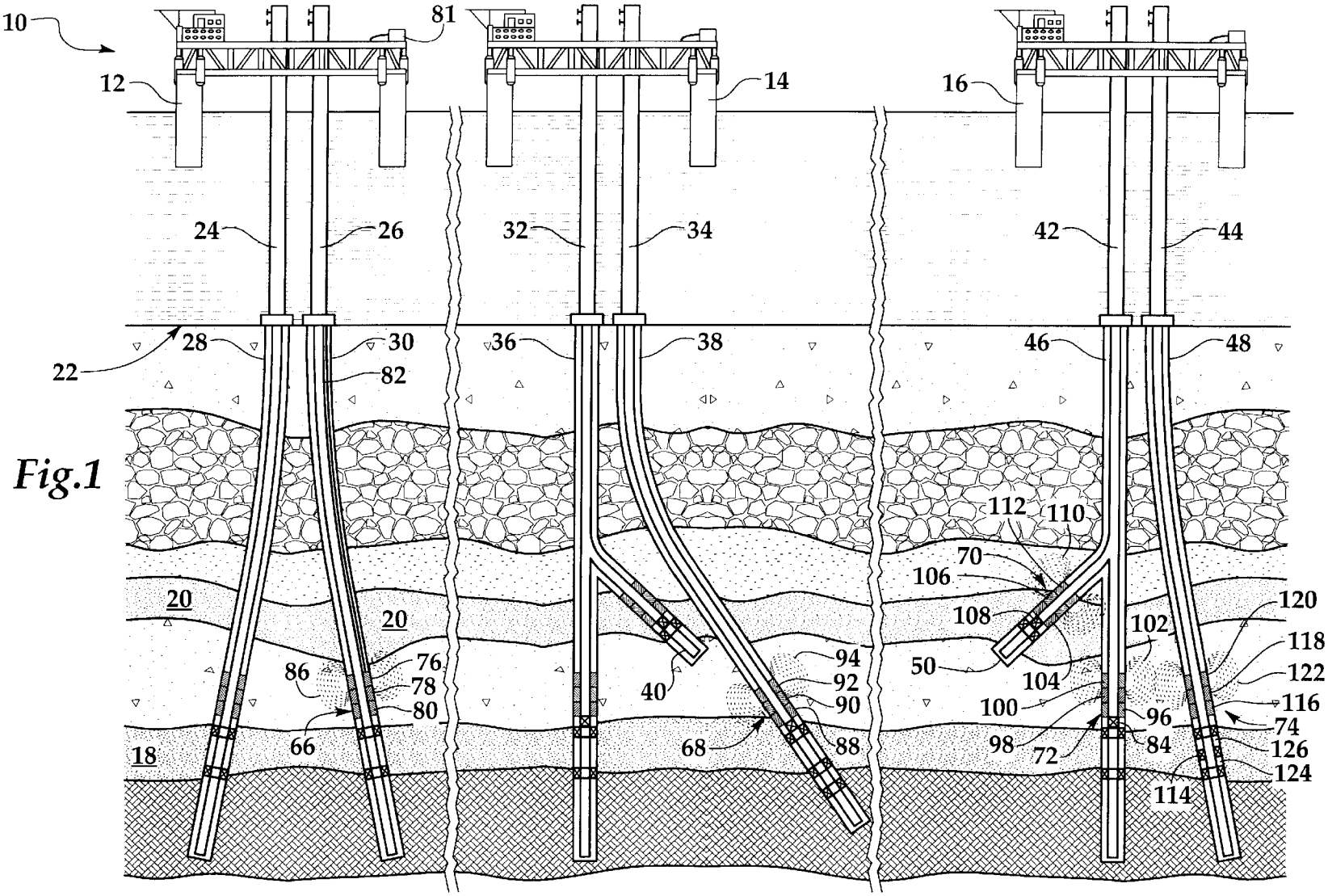
FIG. 1 is a schematic illustration of three offshore oil and gas production platforms in a hydrocarbon field operating an electromagnetic telemetry system of the present invention.

Referring to FIG. 1, an electromagnetic telemetry system in use in an offshore oil and gas field is schematically illustrated and generally designated 10. Semi-submersible platforms 12, 14, 16 are centered over submerged oil and gas formations 18, 20 located below sea floor 22. Wells 24, 26 extend from platform 12 through the sea and penetrate the various earth strata including formation 18, forming, respectively, wellbores 28, 30, each of which may be cased or uncased. Wells 32, 34 extend from platform 14 through the sea and penetrate the various earth strata forming, respectively, wellbores 36, 38. Wellbore 36 includes a lateral or branch wellbore 40 that extends from the primary wellbore 36. The lateral wellbore 40 is completed in formation 20 which may be isolated for selective production independent of production from formation 18 into wellbore 36. Wells 42, 44 extend from platform 16 through the sea and penetrate the various earth strata forming, respectively, wellbores 46, 48. Wellbore 46 includes lateral branch 50.

As part of the final bottom hole assembly prior to production, a master sonde 66 is disposed within wellbore 30, a repeater 68 is disposed within wellbore 38 and slave sondes 70, 72, 74 are respectively disposed within wellbores 50, 46, 48. Master sonde 66 includes an electromagnetic transmitter 76, an electronics package 78 and an electromagnetic receiver 80. Electronics package 78 is electrically connected to a surface installation 81 via a hard wire connection such as electrical wire 82. Alternatively, communication between master sonde 66 and surface installation 81 may be achieved using a variety of communication techniques such as acoustic, pressure pulse, radio transmission, microwave transmission, a fiber optics line or electromagnetic waves. Surface installation 81 may be composed of a computer system that processes, stores and displays information relating to formations 18, 20 such as production parameters including temperature, pressure, flow rates and oil/water ratio. Surface installation 81 also maintains information relating to the operational states of the various downhole devices. Surface installation 81 may include a peripheral computer or a work station with a processor, memory, and audiovisual capabilities. Surface installation 81 includes a power source for producing the necessary energy to operate surface installation 81 as well as the power necessary to operate master sonde 66 via electrical wire 82. Electrical wire 82 may be connected to surface installation 81 using an RS-232 interface.

Surface installation 81 is used to generate command signals that will operate various downhole devices. For example, if the operator wanted to reduce the flow rate of production fluids in well 42, surface installation 81 would be used to generate a command signal to restrict the opening of bottom hole choke 84. The command signal is transmitted to master sonde 66 via electrical wire 82. Electronics package 78 of master sonde 66 processes the command signal and forwards it to electromagnetic transmitter 76. The command signal is then radiated into the earth by electromagnetic transmitter 76 in the form of electromagnetic wave fronts 86. Electromagnetic wave fronts 86 are picked up by electromagnetic receiver 88 of repeater 68. The command signal is processed in electronics package 90 and forwarded to electromagnetic transmitter 92 of repeater 68. The command signal is then radiated into the earth in the form of electromagnetic wave fronts 94. Electromagnetic wave fronts 94 are picked up by electromagnetic receiver 96 of slave sonde 72. The command signal is then forwarded to electronics package 98 of slave sonde 72 for processing and amplification. Electronics package 98 interfaces with bottom hole choke 84 and sends a driver signal to bottom hole choke 84 to restrict the flow rate therethrough.

Once the flow rate in well 42 has been restricted by bottom hole choke 84, bottom hole choke 84 interfaces with electronics package 98 of slave sonde 72 to provide verification that the command generated by surface installation 81 has been accomplished. Electronics package 98 then sends the verification signal to electromagnetic transmitter 100 of slave sonde 72 that radiates electromagnetic wave fronts 102 into the earth. Electromagnetic wave fronts 102 are picked up by electromagnetic receiver 88 of repeater 68. The verification signal is processed by electronics package 90 and forwarded to electromagnetic transmitter 92 that radiates electromagnetic wave fronts 94 into the earth which are picked up by electromagnetic receiver 80 of master sonde 66. The verification signal is passed to electronics package 78 and onto surface installation 81 via electrical wire 82 and placed in memory.

As such, the electromagnetic telemetry system of the present invention is able to operate numerous downhole devices that are disposed at a remote location within a hydrocarbon producing field using a single surface installation 81 and master sonde 66. This is achieved by utilizing a downhole repeater, such as repeater 68, to extend the transmission range of master sonde 66 to remote locations. As used herein, the term "remote" refers to a distance at which reception of electromagnetic wave fronts 86 would be difficult due the attenuation of electromagnetic wave fronts 86 during propagation through earth.

As another example of the use of the electromagnetic telemetry system of the present inventions, the operator may want to shut in production in lateral wellbore 50 of platform 16. Surface installation 81 would generate the shut in command signal and forward it to master sonde 66. Master sonde 66 generates electromagnetic wave fronts 86 which are received and retransmitted by repeater 68, as described above. The shut in command would be picked up by electromagnetic receiver 104 of slave sonde 70 and processed in electronics package 106 of slave sonde 70. Electronics package 106 interfaces with valve 108 causing valve 108 to close. This change in the operational state of valve 108 would be verified to surface installation 81 as described above, by generating electromagnetic wave fronts 110 by electromagnetic transmitter 112 and transmitting the verification to surface installation 81 via electrical wire 82 after retransmission by repeater 68 and reception by electromagnetic receiver 80.

Similarly, the operator may want to actuate a sliding sleeve in a completion with sliding sleeves 114. A command signal would again be generated by surface installation 81 and transmitted to electronics package 78 of master sonde 66 via electrical wire 82. Electromagnetic wave fronts 86 would then be generated by electromagnetic transmitter 76 to transmit the command signal to repeater 68 which, in turn, transmits the command signal to electromagnetic receiver 116 of slave sonde 74. The command signal is forwarded to electronics package 118 for processing, amplification and generation of a driver signal. Electronics package 118 then interfaces with sliding sleeves 124, 126 and sends the driver signal to shut off production from the lower portion of formation 18 by closing sliding sleeve 124 and allow production from the upper portion of formation 18 by opening sliding sleeve 126. Sliding sleeves 124, 126 interface with electronics package 118 of slave sonde 74 to provide verification information regarding their respective changes in operational states. This information is processed and passed to electromagnetic transmitter 120 which generates electromagnetic wave fronts 122. Electromagnetic wave fronts 122 propagated through the earth and are picked up by repeater 68 for processing and retransmission as electromagnetic wave fronts 94 that are picked up by electromagnetic receiver 80 of master sonde 66. The verification information is then passed to electronics package 78 of master sonde 66 for processing and then to surface installation 81 via electrical wire 82 for analysis and storage.

Each of the command signals generated by surface installation 81 are uniquely associated with a particular downhole device such as bottom hole choke 84, valve 108 or sliding sleeves 124, 126. Thus, as will be further discussed with reference to FIGS. 14 and 15 below, electronics package 98 of slave sonde 72 will only process a command signal that is uniquely associated with a downhole device, such as bottom hole choke 84, located within wellbore 46. Electronics package 106 of slave sonde 70 will only process a command signal that is uniquely associated with a downhole device, such as valve 108, located within lateral wellbore 50. Electronics package 118 of slave sonde 74 will only process a command signal uniquely associated with a downhole device, such as sliding sleeves 124, 126, located within wellbore 48.

As electromagnetic wave fronts 86 travel generally horizontally through a single strata, the range of electromagnetic wave fronts 86 will not be limited by the vagaries of transmission through numerous strata as would be required for vertical transmission of an electromagnetic command signal from surface installation 81. The transmission of electromagnetic wave fronts 86 is nonetheless limited by distance and must be amplified by repeater 68 in order to reach a remote location such as slave sondes 70, 72, 74 located respectively in wellbores 50, 46, 48. Likewise, while the transmission of the verification signals as electromagnetic wave fronts 110, 102, 122 respectively from slave sondes 70, 72, 74 are not limited by the vagaries of vertical transmission, the transmission must be amplified by repeater 68 to arrive at master sonde 66.

Even though FIG. 1 depicts three platforms 12, 14, 16, it should be apparent to those skilled in the art that the principles of the present invention are applicable to any number of platforms having any number of wells so long as the wells are within the transmission range of the master sonde and repeaters. As has been noted, the transmission range of electromagnetic waves is significantly greater when transmitting horizontally through a single or limited number of strata as compared with transmitting vertically through numerous strata. For example, electromagnetic waves may travel between 3,000 and 6,000 feet vertically while traveling between 15,000 and 30,000 feet horizontally depending on factors such as the voltage induced in the casing, the radius of the casing, the wall thickness of the casing, the length of the casing, the frequency of transmission, the conductance of the transmission media and the level of noise. As such, multiple stages of repeaters may sometimes be necessary to transmit signals throughout an entire field.

Additionally, while FIG. 1 depicts an offshore environment, it should be understood by one skilled in the art that the system of the present invention is equally well-suited for operation in an onshore environment.

Figure 2:
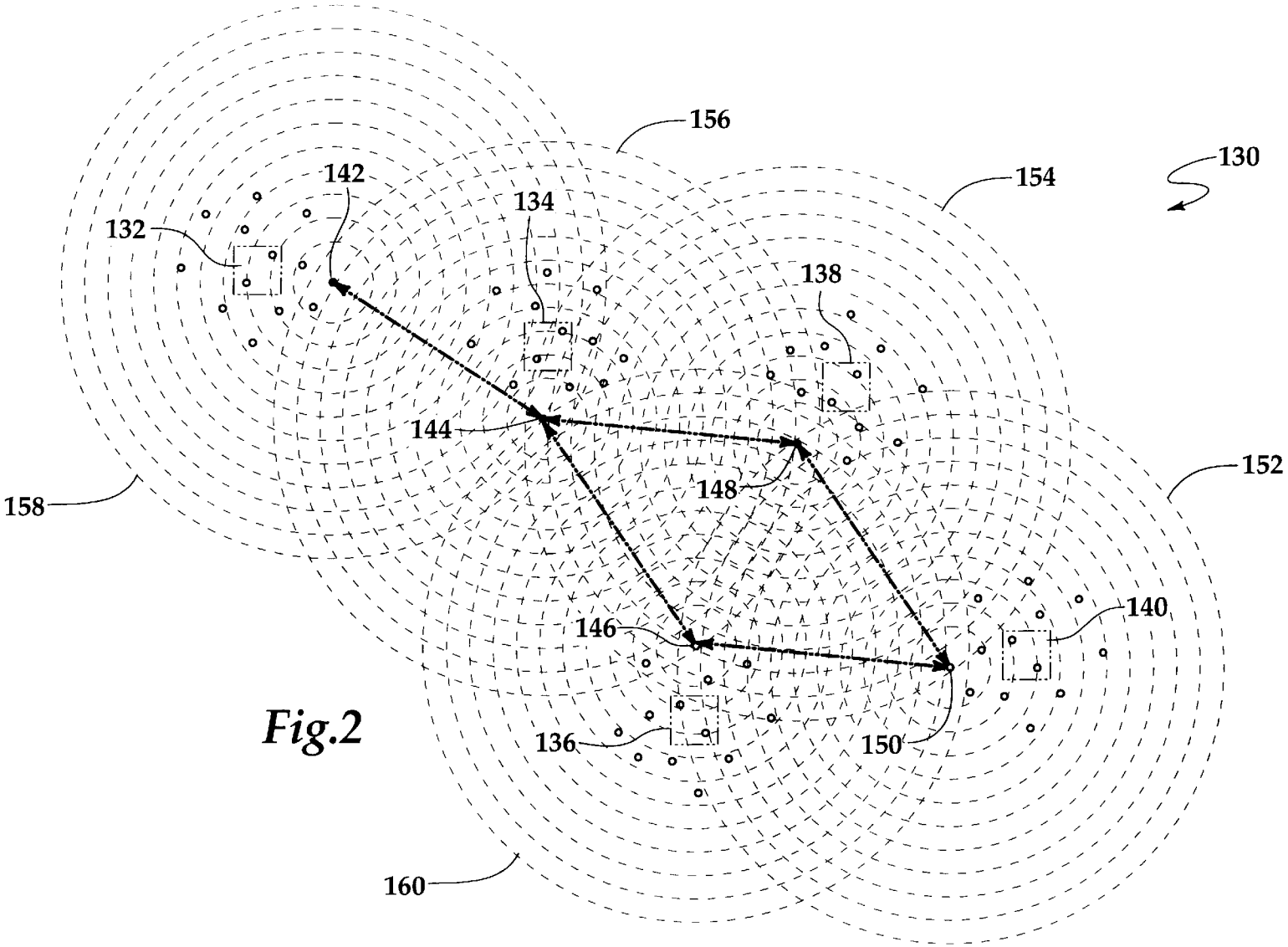
FIG. 2 is a plan view of a hydrocarbon field in which an electromagnetic telemetry system of the present invention is operating.

Referring now to FIG. 2, a plan view of a hydrocarbon field operating an electromagnetic telemetry system of the present invention is depicted and generally designated 130. Five platforms, platform 132, platform 134, platform 136, platform 138 and platform 140 are used to illustrate the operation of an electromagnetic telemetry system of the present invention. Nonetheless, it should be understood by one skilled in the art that the principles of the present invention are applicable to any number of platforms that may be required in a given hydrocarbon field. Each of the platforms depicted in FIG. 2 has a plurality of wells drilled therefrom, such as well 142, well 144, well 146, well 148 and well 150. For convenience of illustration, only the aforementioned wells have reference numerals associated therewith.

In the illustrated embodiment, a master sonde is disposed in well 150. Repeaters are disposed within wells 144, 146, 148. A slave sonde is disposed within well 142. In operation, if the operator of platform 140 desires to change the operational state of a downhole device in well 142, a command signal is sent to the master sonde disposed in well 150. The master sonde will generate electromagnetic wave fronts 152 that are propagated through the earth and picked up by the repeater in well 148. The repeater in well 148 then processes and amplifies the command signal and generates electromagnetic wave fronts 154 which are transmitted through the earth and picked up by the repeater disposed in well 144. The repeater in well 144 processes and amplifies the command signal and retransmits the command signal via electromagnetic wave fronts 156 which are received by the slave sonde in well 142. The slave sonde processes the command signal and generates a driver signal to change the operational state of the desired downhole device. In this scenario, the repeater in well 148 would be considered a stage one repeater while the repeater in well 144 would be considered a stage two repeater. Stage one repeaters receive the original transmission from, for example, a master sonde while stage two repeaters receive a signal from a prior repeater.

It should be understood by one skilled in the art that additional stages of repeaters may be necessary if the distance between the master sonde and the slave sonde in a remote well so requires. Also, it should be understood by one skilled in the art that the master sonde and the slave sonde are considered to be communicably linked to one another even though the information being transmitted therebetween may be retransmitted by one or more repeaters. Likewise, each of the repeaters used to retransmit the information is considered to be communicably linked to both the master sonde and the slave sonde as well as the other repeater that are required to retransmit the information. As such, the use of the terms including "received from," "transmitted to" and the like do not imply that the communication is received directly from or is transmitted directly to a particular communication device, such as a master sonde, a slave sonde or a repeater. The use of such terms only implies that such communication is being received from or transmitted to communication devices that are communicably linked together.

Once the command signal has been received and the change in operational state of the downhole device in well 142 has occurred, a verification signal may be returned. The verification signal is sent by the slave sonde in well 142 via electromagnetic wave fronts 158 that are received by the repeater in well 144 and retransmitted via electromagnetic wave fronts 156 that are received by the repeater in well 148. The repeater in well 148 then retransmits the verification signal via electromagnetic wave fronts 154 that are received by the master sonde in well 150 and returned to the surface installation. In this scenario, the repeater in well 144 is the stage one repeater while the repeater in well 148 is the stage two repeater.

The electromagnetic telemetry system of the present invention includes a fail safe mechanism to assure that a command signal intended for a downhole device in well 142 arrives even if a repeater, such as the repeater in well 148 fails. For example, electromagnetic wave fronts 152 carrying the command signal from the master sonde in well 150 is also received by the repeater in well 146. As such, the repeater in well 146 may also retransmit the command signal via electromagnetic wave fronts 160 which are also received by the repeater in well 144. As above, the repeater in well 144 then retransmits the command signal via electromagnetic wave fronts 156 that are picked up by the slave sonde in well 142 to operate the downhole device. In this configuration, the repeater in well 146 is the stage one repeater while the repeater in well 144 is the stage two repeater. The verification signal may likewise arrive at the master sonde in well 150 even if the repeater in well 148 fails. The verification signal will be carried by electromagnetic wave fronts 158 from the slave sonde in well 142 and picked up by the repeater in well 144. Electromagnetic wave fronts 156 carry the retransmitted verification signal from the repeater in well 144 and are picked up by the repeater in well 146. The repeater in well 146 then retransmits the verification signal via electromagnetic wave fronts 160 that are picked up by the master sonde in well 150 and transmitted to a surface installation. In this configuration, the repeater in well 144 is the stage one repeater while the repeater in well 146 is the stage two repeater.

Even though FIG. 2 has been described with reference to three repeaters located in wells 144, 146, 148, it should be understood by those skilled in the art that numerous other wells may contain repeaters to further enhance the process of communicating signals between a master sonde and a slave sonde. In addition, it should be understood by those skilled in the art that numerous slave sondes in addition to that disposed in well 142 will typically be present such that downhole devices in each of the wells may be operated.

Even though FIG. 2 has been described with reference to transmitting a command signal from a master sonde to a slave sonde and transmitting a verification signal from a slave sonde to a master sonde, it should be understood by those skilled in the art that the disclosed electromagnetic telemetry system is equally well-suited for performing other types of downhole communication. For example, electromagnetic telemetry system of the present invention may utilize the master sonde to periodically poll various downhole devices by sending request messages to the proper slave sondes to obtain formation parameters such as temperature, pressure or flow rate information. Alternatively, slaves sondes may periodically or continuously transmits such formation parameters to the master sonde without request.

Figure 3A:
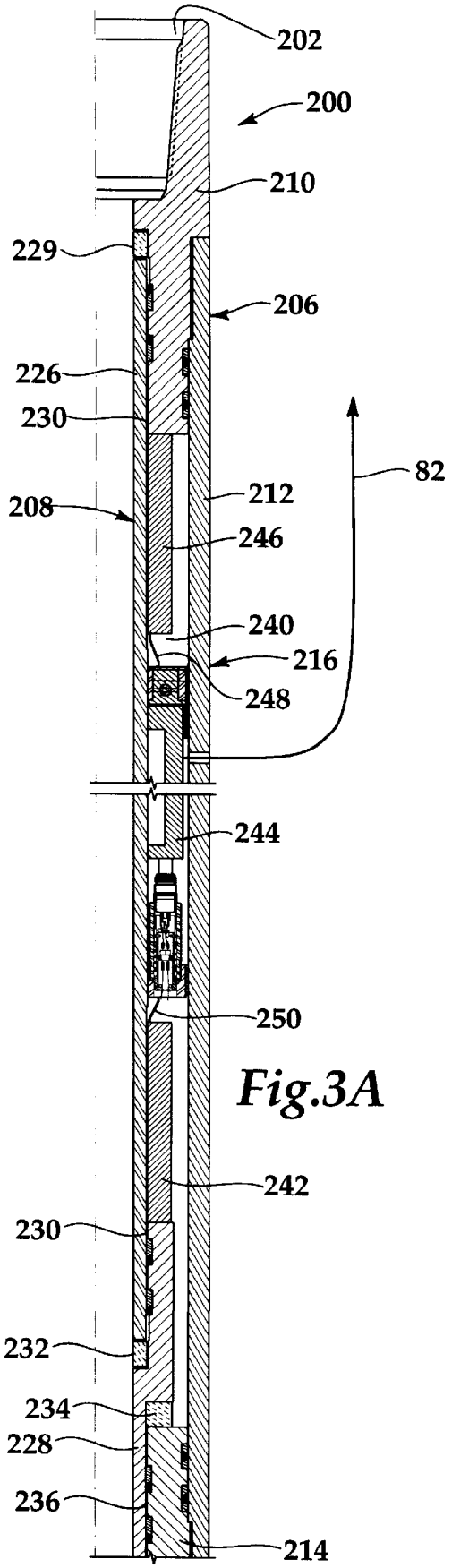
FIGS. 3A–3B are quarter-sectional views of a master sonde of an electromagnetic telemetry system of the present invention.
Figure 3B:
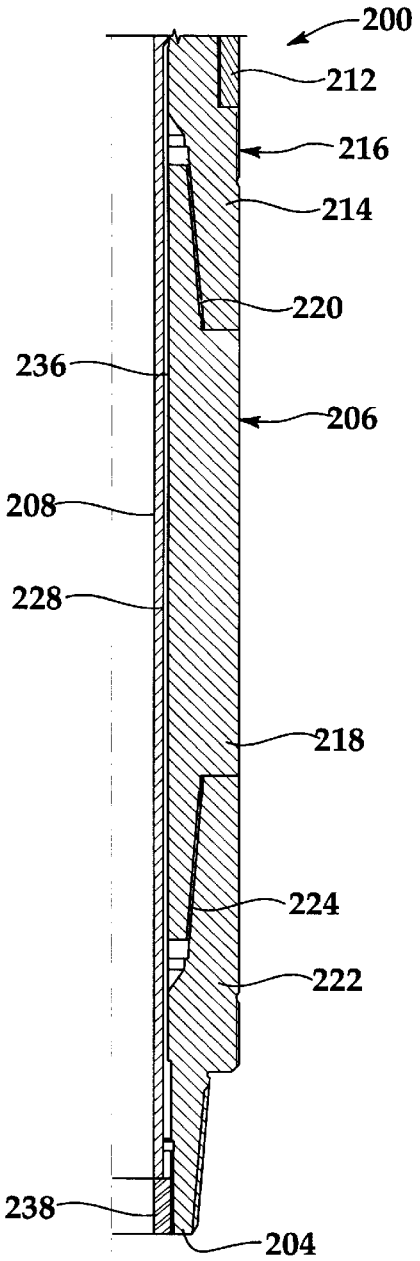

Representatively illustrated in FIGS. 3A–3B is a master sonde 200 of the present invention. For convenience of illustration, FIGS. 3A–3B depict master sonde 200 in a quarter sectional view. Master sonde 200 has a box end 202 and a pin end 204 such that master sonde 200 is threadably adaptable to other tools in a final bottom hole assembly. Master sonde 200 has an outer housing 206 and a mandrel 208 having a full bore so that when master sonde 200 is disposed within a well, tubing may be inserted therethrough. Housing 206 and mandrel 208 protect the operable components of master sonde 200 during installation and production.

Housing 206 of master sonde 200 includes an axially extending and generally tubular upper connector 210. An axially extending generally tubular intermediate housing member 212 is threadably and sealably connected to upper connector 210. An axially extending generally tubular lower housing member 214 is threadably and sealably connected to intermediate housing member 212. Collectively, upper connector 210, intermediate housing member 212 and lower housing member 214 form upper subassembly 216. Upper subassembly 216 is electrically connected to the section of the casing above master sonde 200.

An axially extending generally tubular isolation subassembly 218 is securably and sealably coupled to lower housing member 214. Disposed between isolation subassembly 218 and lower housing member 214 is a dielectric layer 220 that provides electric isolation between lower housing member 214 and isolation subassembly 218. Dielectric layer 220 is composed of a dielectric material, such as teflon, chosen for its dielectric properties and capably of withstanding compression loads without extruding.

An axially extending generally tubular lower connector 222 is securably and sealably coupled to isolation subassembly 218. Disposed between lower connector 222 and isolation subassembly 218 is a dielectric layer 224 that electrically isolates lower connector 222 from isolation subassembly 218. Lower connector 222 is electrically connected to the portion of the casing below master sonde 200.

It should be apparent to those skilled in the art that the use of directional terms such as above, below, upper, lower, upward, downward, etc. are used in relation to the illustrative embodiments as they are depicted in the figures, the upward direction being towards the top of the corresponding figure and the downward direction being toward the bottom of the corresponding figure. It is to be understood that the downhole components described herein, for example, master sonde 200, may be operated in vertical, horizontal, inverted or inclined orientations without deviating from the principles of the present invention.

Mandrel 208 includes axially extending generally tubular upper mandrel section 226 and axially extending generally tubular lower mandrel section 228. Upper mandrel section 226 is partially disposed and sealing configured within upper connector 210. A dielectric member 229 electrically isolates upper mandrel section 226 from upper connector 210. The outer surface of upper mandrel section 226 has a dielectric layer 230 disposed thereon. Dielectric layer 230 may be, for example, a teflon layer. Together, dielectric layer 230 and dielectric member 229 serve to electrically isolate upper connector 210 from upper mandrel section 226.

Between upper mandrel section 226 and lower mandrel section 228 is a dielectric member 232 that, along with dielectric layer 230, serves to electrically isolate upper mandrel section 226 from lower mandrel section 228. Between lower mandrel section 228 and lower housing member 214 is a dielectric member 234. On the outer surface of lower mandrel section 228 is a dielectric layer 236 which, along with dielectric member 234, provides for electric isolation of lower mandrel section 228 from lower housing number 214. Dielectric layer 236 also provides for electric isolation between lower mandrel section 228 and isolation subassembly 218 as well as between lower mandrel section 228 and lower connector 222. Lower end 238 of lower mandrel section 228 is disposed within lower connector 222 and is in electrical communication with lower connector 222. Intermediate housing member 212 of outer housing 206 and upper mandrel section 226 of mandrel 208 define annular area 240. A receiver 242, an electronics package 244 and a transmitter 246 are disposed within annular area 240.

In operation, master sonde 200 receives a command signal from surface installation 81 via electrical wire 82. The command signal is processed by electronics package 244 as will be described in more detail with reference to FIG. 12 and passed on to electromagnetic transmitter 246 via electrical conductor 248. The command signal is then radiated into the earth as electromagnetic waves by electromagnetic transmitter 246. After the electromagnetic command signal is received by a repeater and retransmitted for reception by a slave sonde such that the command may be executed on a downhole device, a verification signal is returned to master sonde 200 in the form of electromagnetic waves. The verification signal is amplified by a repeater and retransmitted as electromagnetic waves which are picked up by electromagnetic receiver 242 and passed on to electronics package 244 via electrical conductor 250 and processed as will be described with reference to FIG. 12. The verification signal is then forwarded to surface installation 81 via electrical wire 82 for analysis and storage.

Figure 4A:
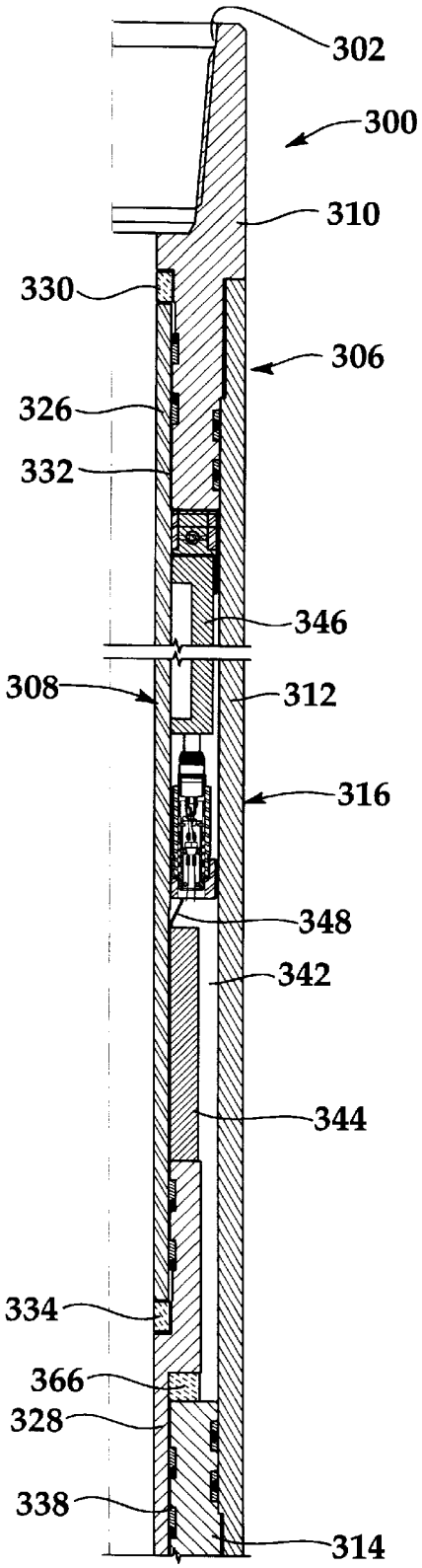
FIGS. 4A–4B are quarter-sectional views of a slave sonde of an electromagnetic telemetry system of the present invention.
Figure 4B:
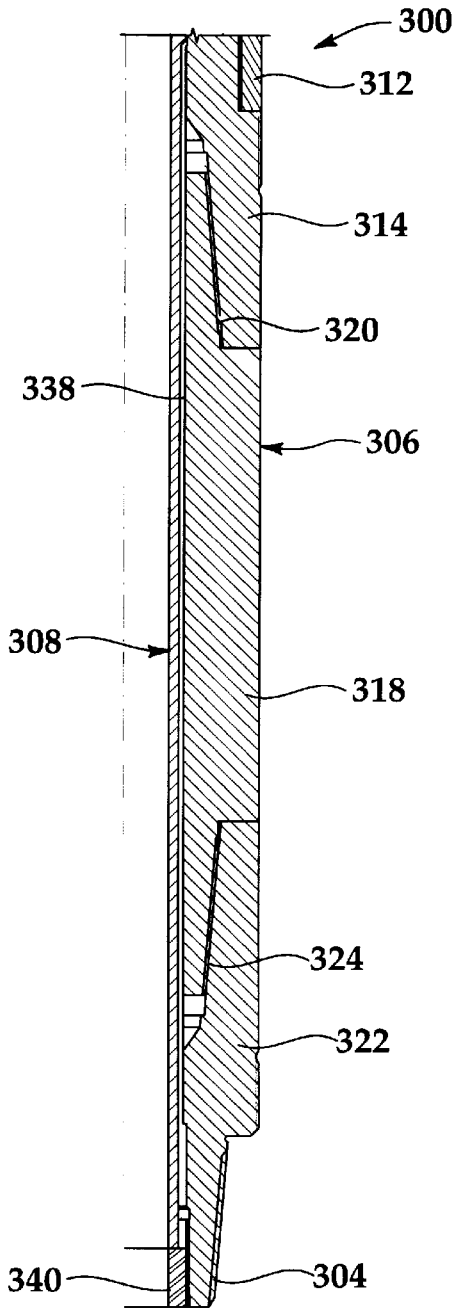

Representatively illustrated in FIGS. 4A–4B is a repeater 300 of the present invention. For convenience of illustration, FIGS. 4A–4B depicted repeater 300 in a quarter sectional view. Repeater 300 has a box end 302 and a pin end 304 such that repeater 300 is threadably adaptable to other tools in a final bottom hole assembly. Repeater 300 has an outer housing 306 and a mandrel 308 having a full bore such that when repeater 300 is disposed within a well, production tubing may be inserted therethrough. Housing 306 and mandrel 308 protect the operable components of repeater 300 during installation and production.

Housing 306 of repeater 300 includes an axially extending and generally tubular upper connector 310. An axially extending generally tubular intermediate housing member 312 is threadably and sealably connected to upper connector 310. An axially extending generally tubular lower housing member 314 is threadably and sealably connected to intermediate housing member 312. Collectively, upper connector 310, intermediate housing member 312 and lower housing member 314 form upper subassembly 316. Upper subassembly 316 is electrically connected to the section of the casing above repeater 300.

An axially extending generally tubular isolation subassembly 318 is securably and sealably coupled to lower housing member 314. Disposed between isolation subassembly 318 and lower housing member 314 is a dielectric layer 320 that provides electric isolation between lower housing member 314 and isolation subassembly 318. Dielectric layer 320 is composed of a dielectric material chosen for its dielectric properties and capably of withstanding compression loads without extruding.

An axially extending generally tubular lower connector 322 is securably and sealably coupled to isolation subassembly 318. Disposed between lower connector 322 and isolation subassembly 318 is a dielectric layer 324 that electrically isolates lower connector 322 from isolation subassembly 318. Lower connector 322 is electrically connected to the portion of the casing below repeater 300.

Mandrel 308 includes axially extending generally tubular upper mandrel section 326 and axially extending generally tubular lower mandrel section 328. Upper mandrel section 326 is partially disposed and sealing configured within upper connector 310. A dielectric member 330 electrically isolates upper mandrel section 326 and upper connector 310. The outer surface of upper mandrel section 326 has a dielectric layer 332 disposed thereon. Dielectric layer 332 may be, for example, a teflon layer. Together, dielectric layer 332 and dielectric member 330 service to electrically isolate upper connector 310 from upper mandrel section 326.

Between upper mandrel section 326 and lower mandrel section 328 is a dielectric member 334 that, along with dielectric layer 332, serves to electrically isolate upper mandrel section 326 from lower mandrel section 328. Between lower mandrel section 328 and lower housing member 314 is a dielectric member 336. On the outer surface of lower mandrel section 328 is a dielectric layer 338 which, along with dielectric member 336, provides for electric isolation of lower mandrel section 328 with lower housing number 314. Dielectric layer 338 also provides for electric isolation between lower mandrel section 328 and isolation subassembly 318 as well as between lower mandrel section 328 and lower connector 322. Lower end 340 of lower mandrel section 328 is disposed within lower connector 322 and is in electrical communication with lower connector 322. Intermediate housing member 312 of outer housing 306 and upper mandrel section 326 of mandrel 308 define annular area 342. A transceiver 344 and an electronics package 346 are disposed within annular area 342.

In operation, repeater 300 receives a command signal in the form of electromagnetic wave fronts generated by an electromagnetic transmitter of a master sonde. Transceiver 344 forwards the command signal to electronics package 346 via electrical conductor 348. Electronics package 346 processes the command signal as will be discussed with reference to FIG. 13. The command signal is forwarded to transceiver 344 and radiated into the earth in the form of electromagnetic waves that are received by a slave sonde that generates a driver signal. The driver signal is forwarded to the downhole device uniquely associated with the command signal to change the operational state of the downhole device. A verification signal in the form of electromagnetic wave fronts is then generated by the slave sonde and returned to transceiver 344 of repeater 300. Transceiver 344 then forwards the verification signal to electronics package 346 for processing as will be described with reference to FIG. 13. The verification signal is then returned to transceiver 344 and transformed into electromagnetic waves which are radiated into the earth and picked up by a receiver on the master sonde for transmission to surface installation 81 via electrical wire 82.

Figure 5A:
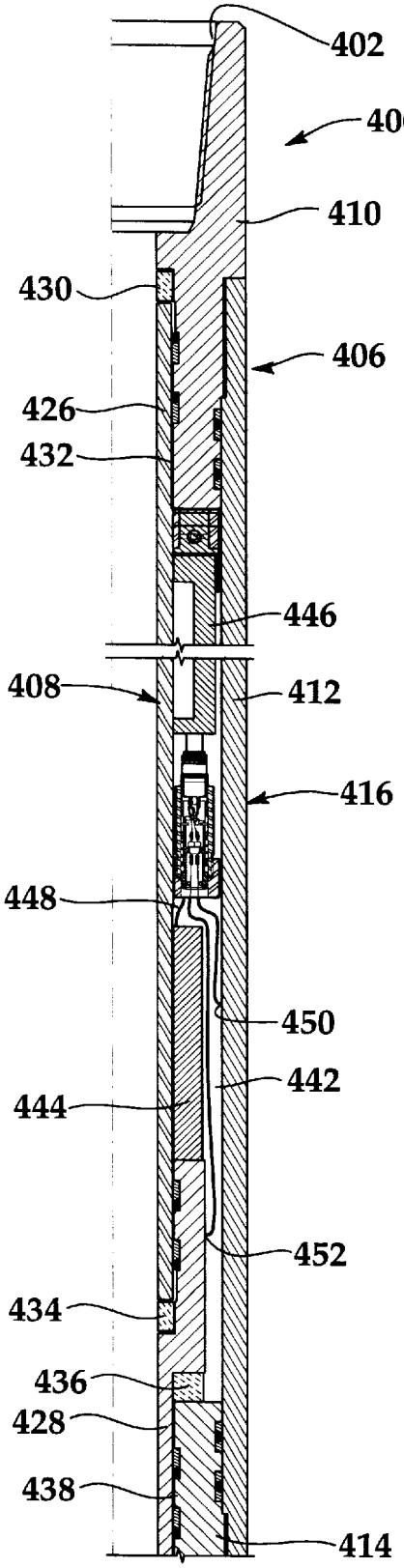
FIG. 5A–5B are quarter-sectional views of a repeater of an electromagnetic telemetry system of the present invention.
Figure 5B:
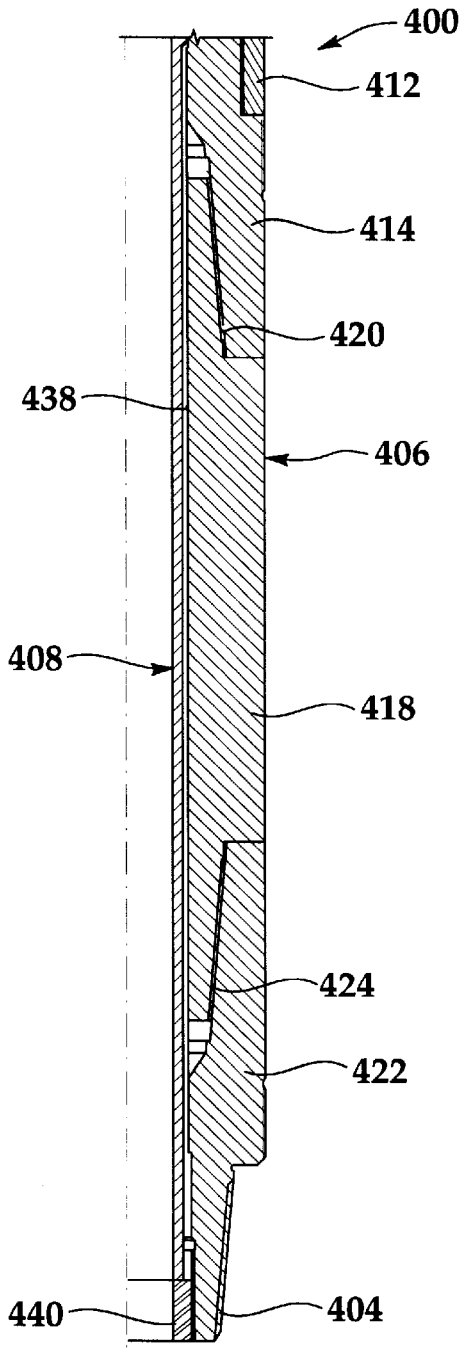

Representatively illustrated in FIGS. 5A–5B is a slave sonde 400 of the present invention. For convenience of illustration, FIGS. 5A–5B depicts slave sonde 400 in a quarter sectional view. Slave sonde 400 has a box end 402 and a pin end 404 such that slave sonde 400 is threadably adaptable to other tools in a final bottom hole assembly. Housing 406 and mandrel 408 protect the operable components of slave sonde 400 during installation and production.

Housing 406 of slave sonde 400 includes an axially extending and generally tubular upper connector 410. An axially extending generally tubular intermediate housing member 412 is threadably and sealably connected to upper connector 410. An axially extending generally tubular lower housing member 414 is threadably and sealably connected to intermediate housing member 412. Collectively, upper connector 410, intermediate housing member 412 and lower housing member 414 form upper subassembly 416. Upper subassembly 416 is electrically connected to the section of the casing above slave sonde 410.

An axially extending generally tubular isolation subassembly 418 is securably and sealably coupled to lower housing member 414. Disposed between isolation subassembly 418 and lower housing member 414 is a dielectric layer 420 that provides electric isolation between lower housing member 414 and isolation subassembly 418. Dielectric layer 420 is composed of a dielectric material chosen for its dielectric properties and capably of withstanding compression loads without extruding.

An axially extending generally tubular lower connector 422 is securably and sealably coupled to isolation subassembly 418. Disposed between lower connector 422 and isolation subassembly 418 is a dielectric layer 424 that electrically isolates lower connector 422 from isolation subassembly 418. Lower connector 422 is electrically connected to the portion of the casing below slave sonde 400.

Mandrel 408 includes axially extending generally tubular upper mandrel section 426 and axially extending generally tubular lower mandrel section 428. Upper mandrel section 426 is partially disposed and sealing configured within upper connector 410. A dielectric member 430 electrically isolates upper mandrel section 426 and upper connector 410. The outer surface of upper mandrel section 426 has a dielectric layer 432 disposed thereon. Dielectric layer 432 may be, for example, a teflon layer. Together, dielectric layer 432 and dielectric member 430 service to electrically isolate upper connector 410 from upper mandrel section 426.

Between upper mandrel section 426 and lower mandrel section 428 is a dielectric member 434 that, along with dielectric layer 432, serves to electrically isolate upper mandrel section 426 from lower mandrel section 428. Between lower mandrel section 428 and lower housing member 414 is a dielectric member 436. On the outer surface of lower mandrel section 428 is a dielectric layer 438 which, along with dielectric member 436, provides for electric isolation of lower mandrel section 428 with lower housing number 414. Dielectric layer 438 also provides for electric isolation between lower mandrel section 428 and isolation subassembly 418 as well as between lower mandrel section 428 and lower connector 422. Lower end 440 of lower mandrel section 428 is disposed within lower connector 422 and is in electrical communication with lower connector 422. Intermediate housing member 412 of outer housing 406 and upper mandrel section 426 of mandrel 408 define annular area 442. A receiver 444 and an electronics package 446 are disposed within annular area 442.

In operation, receiver 444 of slave sonde 400 receives a command signal in the form of electromagnetic waves generated by the master sonde and amplified by a repeater. Receiver 444 forwards the command signal to electronics package 446 via electrical conductor 448. Electronics package 446 processes the command signal and generates a driver signal that is forwarded to the downhole device uniquely associated with the command signal to change the operational state of the downhole device. A verification signal is returned to electronics package 446 from the downhole device.

Electronics package 446 processes and amplifies the verification signal. Electronics package 446 then generates an output voltage that is applied between intermediate housing member 412 and lower mandrel section 428, which is electrically isolated from intermediate housing member 412 and electrically connected to lower connector 422, via terminal 450 on intermediate housing member 412 and terminal 452 on lower mandrel section 428. The voltage applied between intermediate housing member 412 and lower connector 422 generates electromagnetic waves carrying the verification signal that are radiated into the earth and picked up by a repeater for amplification and retransmission via electromagnetic waves that are picked up by the receiver on the master sonde for transmission to surface installation 81 via electrical wire 82.

Figure 6:
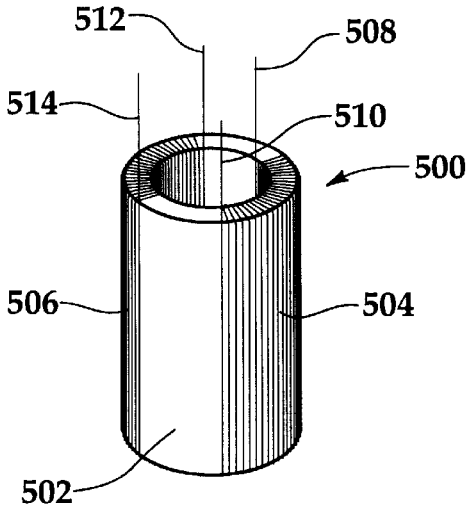
FIG. 6 is a schematic illustration of a toroid having primary and secondary windings wrapped therearound for a master sonde, a slave sonde or a repeater of an electromagnetic telemetry system of the present invention.

Referring now to FIG. 6, a schematic illustration of a toroid is depicted and generally designated 500. Toroid 500 includes magnetically permeable annular core 502, a plurality of electrical conductor windings 504 and a plurality of electrical conductor windings 506. Windings 504 and windings 506 are each wrapped around annular core 502. Collectively, annular core 502, windings 504 and windings 506 serve to approximate an electrical transformer wherein either windings 504 or windings 506 may serve as the primary or the secondary of the transformer.

In one embodiment, the ratio of primary windings to secondary windings is 2:1. For example, the primary windings may include 100 turns around annular core 502 while the secondary windings may include 50 turns around annular core 502. In another embodiment, the ratio of secondary windings to primary windings is 4:1. For example, primary windings may include 10 turns around annular core 502 while secondary windings may include 40 turns around annular core 502. It will be apparent to those skilled in the art that the ratio of primary windings to secondary windings as well as the specific number of turns around annular core 502 will vary based upon factors such as the diameter and height of annular core 502, the desired voltage, current and frequency characteristics associated with the primary windings and secondary windings and the desired magnetic flux density generated by the primary windings and secondary windings.

Toroid 500 of the present invention may serve, for example, as electromagnetic receiver 242 or electromagnetic transmitter 246 of FIG. 3, electromagnetic transceiver 344 of FIG. 4 or electromagnetic receiver 444 of FIG. 5. The following description of the orientation of windings 504 and windings 506 will therefore be applicable to each of the above.

With reference to FIGS. 3 and 6, windings 504 have a first end 508 and a second end 510. First end 508 of windings 504 is electrically connected to electronics package 244. When toroid 500 serves as electromagnetic receiver 242, windings 504 serve as the secondary wherein first end 508 of windings 504 feeds electronics package 242 with the verification signal via electrical conductor 244. The verification signal is processed by electronics package 242 as will be further described with reference to FIG. 12 below. When toroid 500 serves as electromagnetic transmitter 246, windings 504 serve as the primary wherein first end 508 of windings 504, receives the command signal from electronics package 244 via electrical conductor 248. Second end 510 of windings 504 is electrically connected to upper subassembly 216 of outer housing 206 which serves as a ground.

Windings 506 of toroid 500 have a first end 512 and a second end 514. First end 512 of windings 506 is electrically connected to upper subassembly 216 of outer housing 206. Second end 514 of windings 506 is electrically connected to lower connector 222 of outer housing 206. First end 512 of windings 506 is thereby separated from second end 514 of windings 506 by isolations subassembly 218 which prevents a short between first end 512 and second end 514 of windings 506.

When toroid 500 serves as electromagnetic receiver 242, electromagnetic wave fronts induce a current in windings 506, which serve as the primary. The current induced in windings 506 induces a current in windings 504, the secondary, which feeds electronics package 244 as described above. When toroid 500 serves as electromagnetic transmitter 246, the current supplied from electronics package 244 feeds windings 504, the primary, such that a current is induced in windings 506, the secondary. The current in windings 506 induces an axial current on the casing, thereby producing electromagnetic waves.

Due to the ratio of primary windings to secondary windings, when toroid 500 serves as electromagnetic receiver 242, the signal carried by the current induced in the primary windings is increased in the secondary windings. Similarly, when toroid 500 serves as electromagnetic transmitter 246, the current in the primary windings is increased in the secondary windings.

Figure 7:
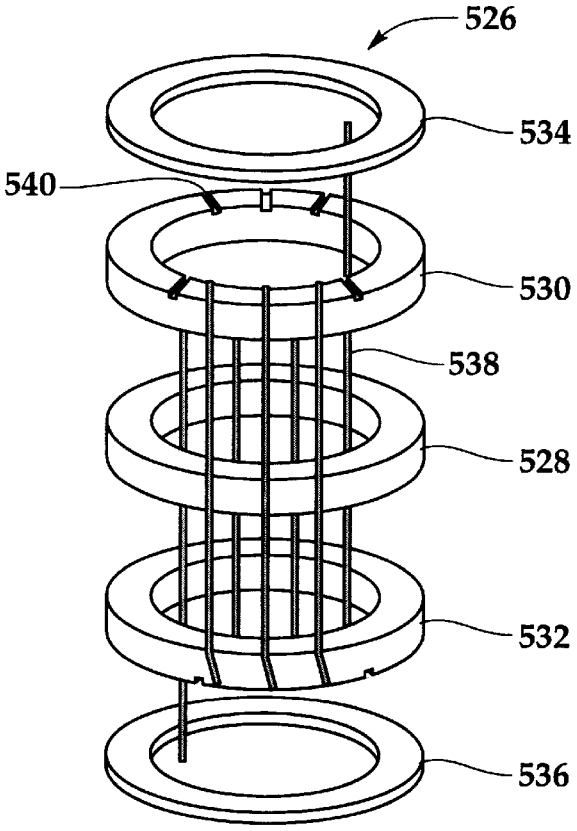
FIG. 7 is an exploded view of one embodiment of a toroid assembly for use as a receiver in an electromagnetic telemetry system of the present invention.

Referring now to FIG. 7, an exploded view of a toroid assembly 526 is depicted. Toroid assembly 526 may be designed to serve, for example, as electromagnetic receiver 242 of FIG. 3. Toroid assembly 526 includes a magnetically permeable core 528, an upper winding cap 530, a lower winding cap 532, an upper protective plate 534 and a lower protective plate 536. Winding caps 530, 532 and protective plates 534, 536 are formed from a dielectric material such as fiberglass or phenolic. Windings 538 are wrapped around core 528 and winding caps 530, 532 by inserting windings 538 into a plurality of slots 540 which, along with the dielectric material, prevent electrical shorts between the turns of winding 538. For illustrative purposes, only one set of winding, windings 538, have been depicted. It will be apparent to those skilled in the art that, in operation, a primary and a secondary set of windings will be utilized by toroid assembly 526.

Figure 8:
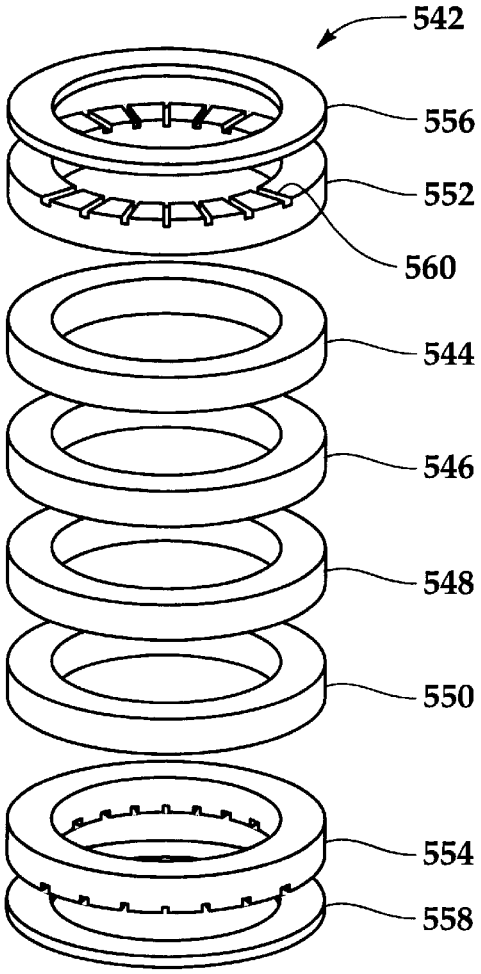
FIG. 8 is an exploded view of one embodiment of a toroid assembly for use as a transmitter in an electromagnetic telemetry system of the present invention.

FIG. 8 depicts an exploded view of toroid assembly 542 which may serve, for example, as electromagnetic transmitter 246 of FIG. 3. Toroid assembly 542 includes four magnetically permeable cores 544, 546, 548 and 550 between an upper winding cap 552 and a lower winding cap 554. An upper protective plate 556 and a lower protective plate 558 are disposed respectively above and below upper winding cap 552 and lower winding cap 554. In operation, primary and secondary windings (not pictured) are wrapped around cores 544, 546, 548 and 550 as well as upper winding cap 552 and lower winding cap 554 through a plurality of slots 560.

As is apparent from FIGS. 7 and 8, the number of magnetically permeable cores such as core 528 and cores 544, 546, 548 and 550 may be varied, dependent upon the required length for the toroid as well as whether the toroid serves as a receiver, such as toroid assembly 526, or a transmitter, such as toroid assembly 542. In addition, as will be known by those skilled in the art, the number of cores will be dependent upon the diameter of the cores as well as the desired voltage, current and frequency carried by the primary windings and the secondary windings, such as windings 538.

Figure 9:
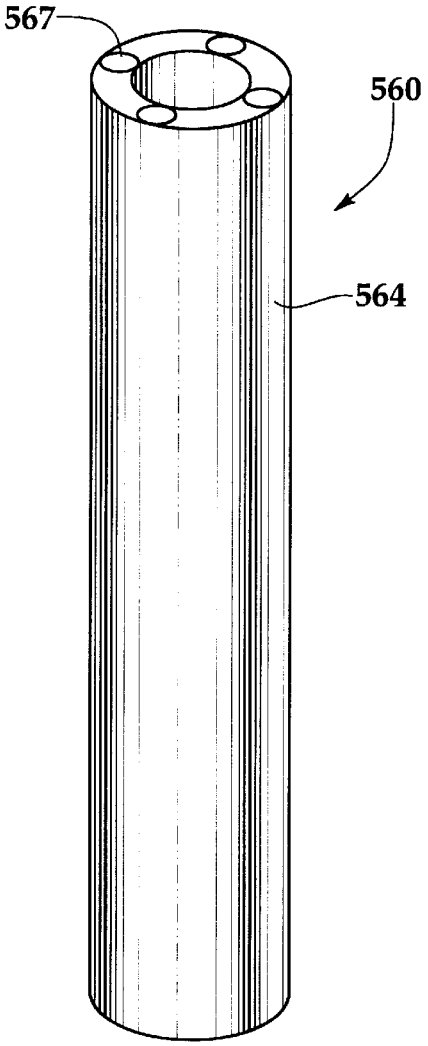
FIG. 9 is a perspective view of an annular carrier of an electronics package for use in an electromagnetic telemetry system of the present invention.
Figure 10:
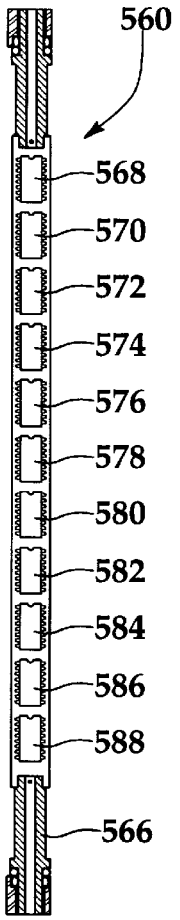
FIG. 10 is a perspective view of an electronics member having a plurality of electronic devices thereon for use in an electromagnetic telemetry system of the present invention.
Figure 11:
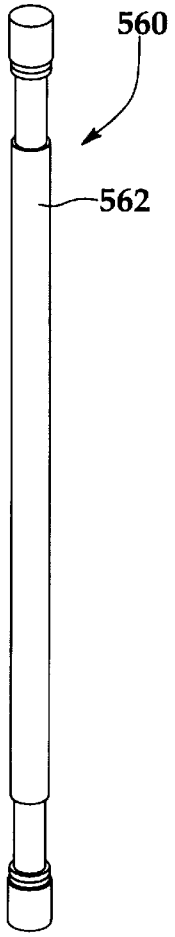
FIG. 11 is a perspective view of a battery pack for use in an electromagnetic telemetry system of the present invention.

Turning next to FIGS. 9, 10 and 11 collectively, therein is depicted the components of an electronics package 560 of the present invention. Electronics package 560 may serve as the electronics package used in the repeaters or slave sondes described above. Electronics package 560 may also serve as the electronics package used in the master sonde described above but without the need for battery pack 562 as power is supplied to the master sonde from the surface installation 81 via electrical wire 82. Electronics package 560 includes an annular carrier 564, an electronics member 566 and one or more battery packs 562. Annular carrier 560 is disposed, for example, between outer housing 206 and mandrel 208 of master sonde 200 depicted in FIG. 3. Annular carrier 564 includes a plurality of axial openings 567 for receiving either electronics member 566 or battery packs 562.

Even though FIG. 9 depicts four axial openings 567, it should be understood by one skilled in the art that the number of axial openings in annular carrier 560 may be varied. Specifically, the number of axial openings 567 will be dependent upon the number of battery packs 562 that are required.

Electronics member 566 is insertable into an axial opening 567 of annular carrier 564. Electronics member 566 receives a command signal from first end 508 of windings 504 when toroid 500 serves as, for example, electromagnetic transceiver 342 of FIG. 4. Electronics member 566 includes a plurality of electronic devices such as limiter 568, preamplifier 570 notch filter 572, bandpass filters 574, phase lock loop 576, clock 578, shift registers 580, comparators 582, parity check 584, storage device 586, and amplifier 588. The operation of such electronic devices will be more full discussed with reference to FIGS. 12–14.

Battery packs 562 are insertable into axial openings 567 of annular carrier 564. Battery packs 562, which includes batteries such as nickel cadmium batteries or lithium batteries, are configured to provide the proper operating voltage and current to the electronic devices of electronics member 566 and to toroid 500.

Figure 12:
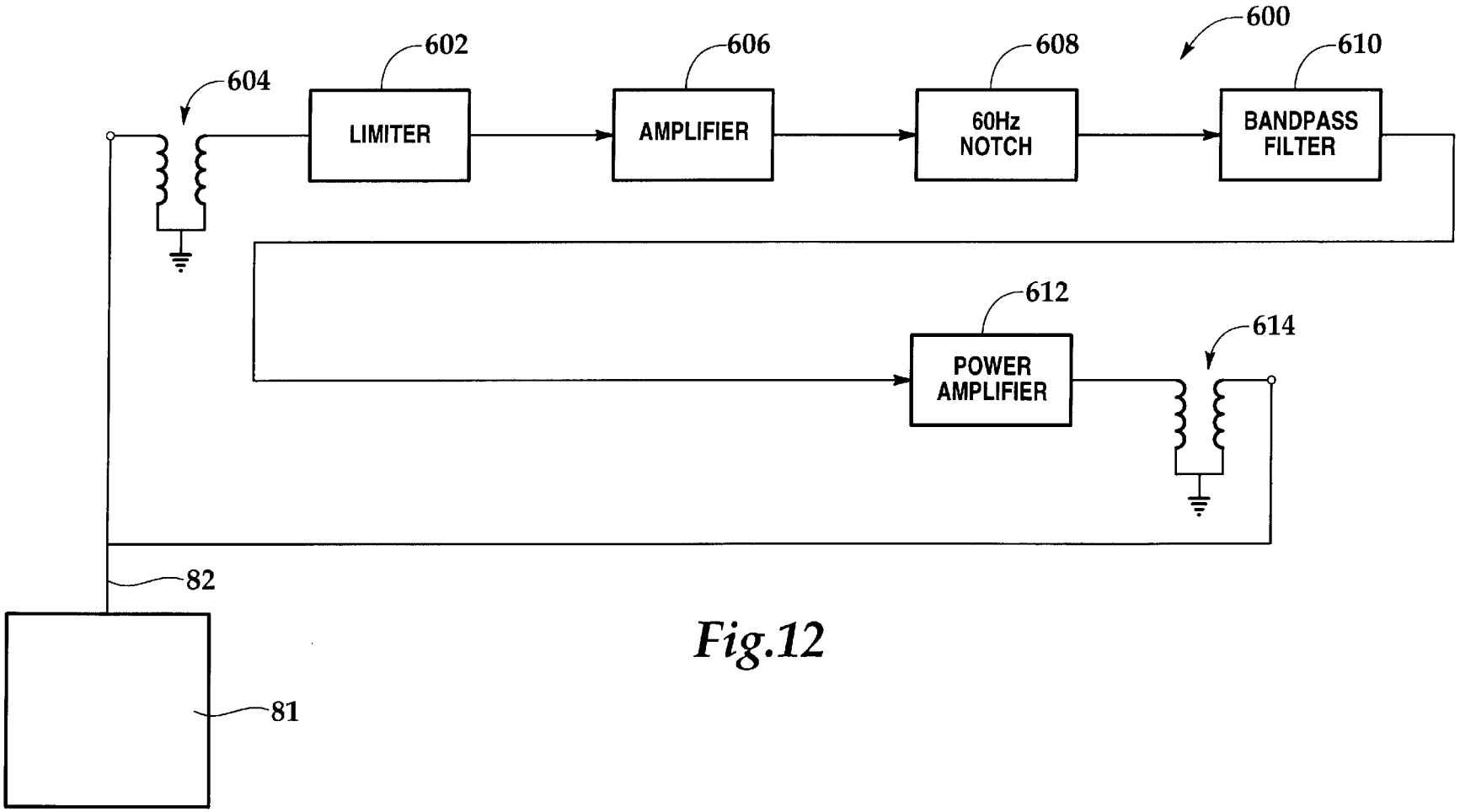
FIG. 12 is a block diagram of a signal processing method used by a master sonde of an electromagnetic telemetry system of the present invention.

Turning now to FIG. 12 and with reference to FIG. 1, one embodiment of the method for processing the command signal by master sonde 66 is described. The method 600 utilizes a plurality of electronic devices such as those described with reference to FIG. 9. Method 600 provides for amplification and processing of the command signal that is generated by surface installation 81. Limiter 602 receives the command signal from receiver 604. Limiter 602 may include a pair of diodes for attenuating the noise in the command signal to a predetermined range, such as between about 0.3 and 0.8 volts. The command signal is then passed to amplifier 606 which may amplify the command signal to a predetermined voltage, acceptable for circuit logic, such as 5 volts. The command signal is then passed through a notch filter 608 to shunt noise at a predetermined frequency, such as 60 hertz which is a typical frequency for electrical noise in the United States whereas a European application may have a 50 hertz notch filter. The command signal then enters a bandpass filter 610 to eliminate noise above and below the desired frequency and to recreate the original waveform having the original frequency, for example, two hertz. The command signal is then increased in power amplifier 612 and passed on to electromagnetic transmitter 614. Transmitter 614 transforms the electrical command signal into an electromagnetic command signal, such as electromagnetic wave fronts 86, which are radiated into the earth to be picked up by electromagnetic receiver 88 of repeater 68.

In a similar manner, method 600 provides for amplification and processing of the verification signal generated by a slave sonde, such a slave sondes 70, 72, 74. Limiter 602 receives the verification signal from receiver 604. Limiter 602 may attenuate the noise in the verification signal to a predetermined range, such as between 0.3 and 0.8 volts. The verification signal is then passed to amplifier 606 which may amplify the verification signal to a predetermined voltage, such as 5 volts. The verification signal is then passed through notch filter 608 to shunt noise at a predetermined frequency. The verification signal then enters bandpass filter 610 to eliminate unwanted frequencies above and below the desired frequency, for example, 2 hertz. The verification signal then passes into power amplifier 612 to boost the verification signal before the verification signal is transmitted to surface installation 81 via electrical wire 82.

Figure 13:
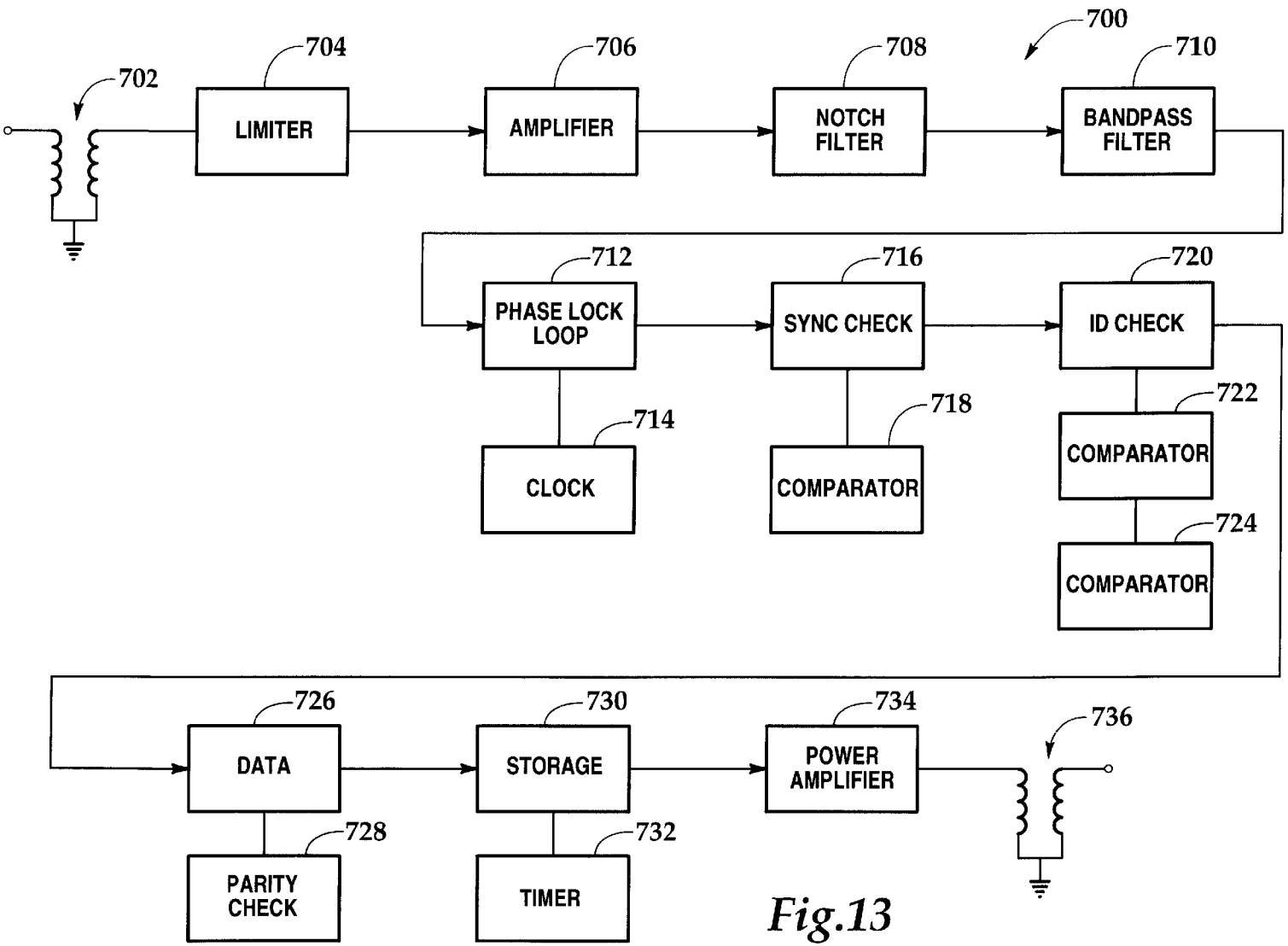
FIG. 13 is a block diagram of a signal processing method used by a repeater of an electromagnetic telemetry system of the present invention.

Turning now to FIG. 13 and with reference to FIG. 1, one embodiment of the method for processing an electrical signal within a repeater, such as repeater 68 is described. The method 700 utilizes a plurality of electronic devices such as those described with reference to FIG. 10. Method 700 provides for digital processing of the information carried in the electrical signal that is generated by receiver 702. Limiter 704 receives the electrical signal from receiver 702. Limiter 704 may include a pair of diodes for attenuating the noise in the electrical signal to a predetermined range, such as between about 0.3 and 0.8 volts. The electrical signal is then passed to amplifier 706 which may amplify the electrical signal to a predetermined voltage suitable of circuit logic, such as five volts. The electrical signal is then passed through a notch filter 708 to shunt noise at a predetermined frequency, such as 60 hertz. The electrical signal then enters a bandpass filter 710 to eliminate unwanted frequencies above and below the desired frequency to recreate a signal having the original frequency, for example, two hertz.

The electrical signal is then fed through a phase lock loop 712 that is controlled by a precision clock 714 to assure that the electrical signal which passes through bandpass filter 710 has the proper frequency and is not simply noise. As the electrical signal will include a certain amount of carrier frequency, phase lock loop 712 is able to verify that the received signal is, in fact, a signal carrying information to be retransmitted. The electrical signal then enters a series of shift registers that perform a variety of error checking features.

Sync check 716 reads, for example, the first six bits of the information carried in the electrical signal. These first six bits are compared with six bits that are stored in comparator 718 to determine whether the electrical signal is carrying the type of information intended for a repeater. For example, the first six bits in the preamble to the information carried in electromagnetic wave fronts 86 must carry the code stored in comparator 718 in order for the electrical signal to pass through sync check 716. Each of the repeaters of the present invention may require the same code in comparator 718. Alternatively, each of the repeaters that serve as stage one repeaters may have the same code in comparator 718 while each of the repeaters that serve as stage two repeaters may use a code in comparator 718 that is different than that of the stage one repeater code.

If the first six bits in the preamble correspond with that in comparator 718, the electrical signal passes to an identification check 720. Identification check 720 determines whether the information received by a specific repeater should be retransmitted. Identification check 720 will have a plurality of comparators associated therewith that correspond to specific downhole devices. Identification check 720 will only forward the electrical signals that include the preprogrammed code stored in one of the comparators. Thus, one or more selected repeaters at each repeater stage are used to retransmit the command signal or the verification signal from specific downhole devices. For convenience of illustration, two comparators, comparator 722 and comparator 724, have been depicted, however, the actual number of comparators will depend upon the specific number of downhole devices that are associated with each repeater.

After passing through identification check 720, the electrical signal is shifted into a data register 726 which is in communication with a parity check 728 to analyze the information carried in the electrical signal for errors and to assure that noise has not infiltrated and abrogated the data stream by checking the parity of the data stream. If no errors are detected, the electrical signal is shifted into one or more storage registers 730. Storage registers 730 receive the entire sequence of information and either pass the electrical signal directly into power amplifier 734 for retransmission by transmitter 736, if the repeater is the primary repeater for a specific downhole device, or will store the information for a specified period of time determined by timer 732, if the repeater is a secondary repeater for a specific downhole device. For example, as described with reference to FIG. 2, the electromagnetic wave fronts from a master sonde will arrive at more than one repeater that is associated with a specific downhole device. If the primary repeater associated with a specific downhole device is unable to retransmit the command signal, after a predetermined period of time, a secondary repeater associated with the specific downhole device will retransmit the command signal. In a similar manner, a verification signal received from a specific downhole device will be retransmitted by a primary repeater but, if the primary repeater fails to retransmit the verification signal, a secondary repeater will do so.

Even though FIG. 13 has described sync check 716, identification check 720, data register 726 and storage register 730 as shift registers, it should be apparent to those skilled in the art that alternate electronic devices may be used for error checking and storage including, but not limited to, random access memory, read only memory, erasable programmable read only memory and a microprocessor.

Figure 14:
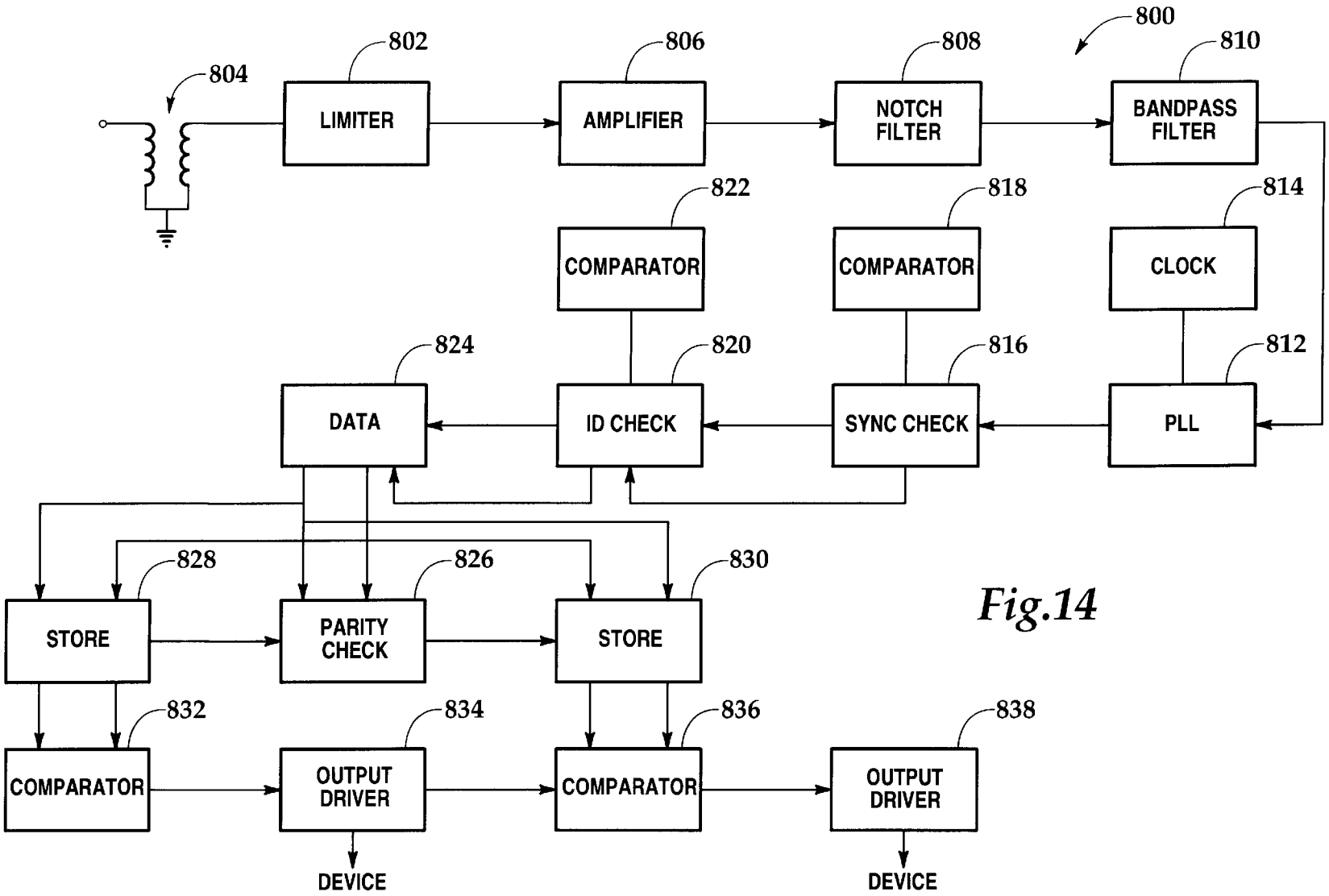
FIG. 14 is a block diagram of a signal processing method used by a slave sonde of an electromagnetic telemetry system of the present invention.

Turning now to FIG. 14 and with reference to FIG. 1, one embodiment of the method for processing the command signal by slave sondes 70, 72, 74 is described. The method 800 utilizes a plurality of electronic devices such as those described with reference to FIG. 9. Method 800 provides for digital processing of the command signal that is generated by surface installation 81 and electromagnetically transmitted by master sonde 66 and retransmitted by repeater 68. Limiter 802 receives the command signal from electromagnetic receiver 804. Limiter 802 may include a pair of diodes for attenuating the noise in the command signal to a predetermined range, such as between about 0.3 and 0.8 volts. The command signal is then passed to amplifier 806 which may amplify the command signal to a predetermined voltage suitable for circuit logic, such as 5 volts. The command signal is then passed through a notch filter 808 to shunt noise at a predetermined frequency, such as 60 hertz. The command signal then enters a bandpass filter 810 to attenuate high noise and low noise and to recreate the original waveform having the original frequency, for example, two hertz.

The command signal is then fed through a phase lock loop 812 that is controlled by a precision clock 814 to assure that the command signal which passes through bandpass filter 810 has the proper frequency and is not simply noise. As the command signal will include a certain amount of carrier frequency first, phase lock loop 812 is able to verify that the received signal is, in fact, a command signal. The command signal then enters and series of shift registers that perform a variety of error checking features.

Sync check 816 reads, for example, the first six bits of the information carried in the command signal. These first six bits are compared with six bits that are stored in comparator 818 to determine whether the command signal is carrying the type of information intended for a slave sonde, such as slave sondes 70, 72, 74. For example, the first six bits in the preamble of the command signal must carry the code stored in comparator 818 in order for the command signal to pass through sync check 816. Each of the slave sondes of the present invention may use the same code in comparator 818.

If the first six bits in the preamble correspond with that in comparator 818, the command signal passes to an identification check 820. Identification check 820 determines whether the command signal is uniquely associated with a specific downhole device controlled by that slave sonde. For example, the comparator 822 of slave sonde 70 will require a specific binary code while comparator 822 of slave sonde 72 will require a different binary code. Specifically, if the command signal is uniquely associated with bottom hole choke 84, the command signal will include a binary code that will correspond with the binary code stored in comparator 822 of slave sonde 72.

After passing through identification check 820, the command signal is shifted into a data register 824 which is in communication with a parity check 826 to analyze the information carried in the command signal for errors and to assure that noise has not infiltrated and abrogated the data stream by checking the parity of the data stream. If no errors are detected, the command signal is shifted into storage registers 828, 830. For example, once the command signal has been shifted into storage register 828, a binary code carried in the command signal is compared to that stored in comparator 832. If the binary code of the command signal matches that in comparator 832, the command signal is passed onto output driver 834. Output driver 834 generates a driver signal that is passed to the proper downhole device such that the operational state of the downhole device is changed. For example, slave sonde 70 may generate a driver signal to change the operational state of valve 108 from open to closed.

Similarly, the binary code in the command signal that is stored in storage register 830 is compared with that in comparator 836. If the binary codes match, comparator 836 forwards the command signal to output driver 838. Output driver 838 generates a driver signal to operate another downhole device. For example, slave sonde 70 may generate a driver signal to change the operational state of valve 108 from closed to open.

Once the operational state of the downhole device has been changed according to the command signal, a verification signal is generated and returned to slave sonde 70. The verification signal is processed by slave sonde 70 in a manner similar to that described above with reference to processing the verification signal by master sonde 66 corresponding to FIG. 12. After the verification signal is processed by slave sonde 70, the verification signal is passed on to electromagnetic transmitter 112 of slave sonde 70. Electromagnetic transmitter 112 transforms the verification signal into electromagnetic wave fronts 110, which are radiated into the earth to be picked up by electromagnetic receiver 88 of repeater 68 and processed as described with reference to FIG. 13. Electromagnetic transmitter 92 then generates electromagnetic wave fronts 94 that are picked up by electromagnetic receiver 80 of master sonde 66. As explained above, the verification signal is then processed in master sonde 66 and forwarded to surface installation 81 via electrical wire 82.

Even though FIG. 14 has described sync check 816, identifier check 820, data register 824 and storage registers 828, 830 as shift registers, it should be apparent to those skilled in the art that alternate electronic devices may be used for error checking and storage including, but not limited to, random access memory, read only memory, erasable programmable read only memory and a microprocessor.

Figure 15A:
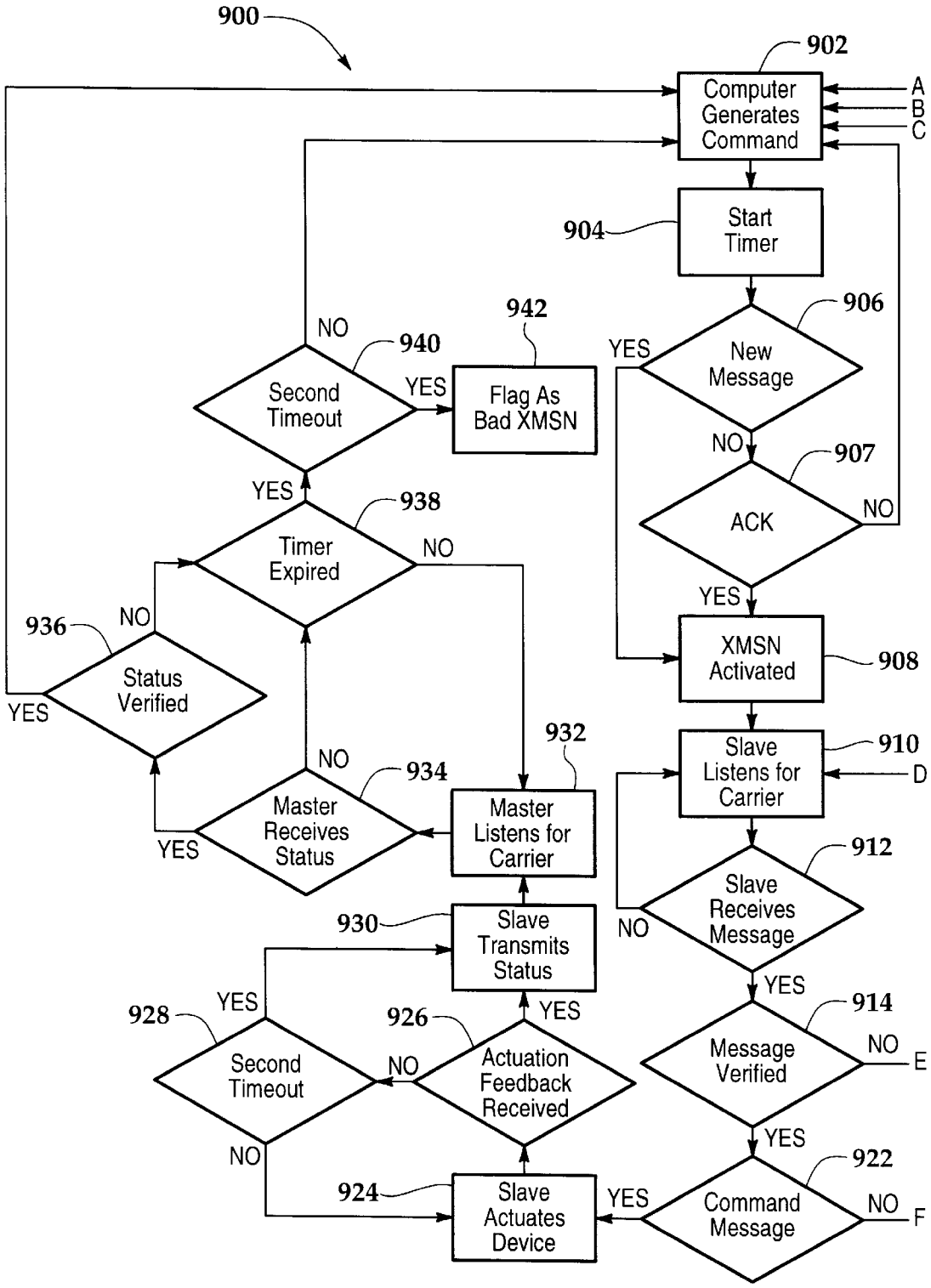
FIGS. 15A–15B are flow diagrams of a method for operating an electromagnetic telemetry system of the present invention.
Figure 15B:
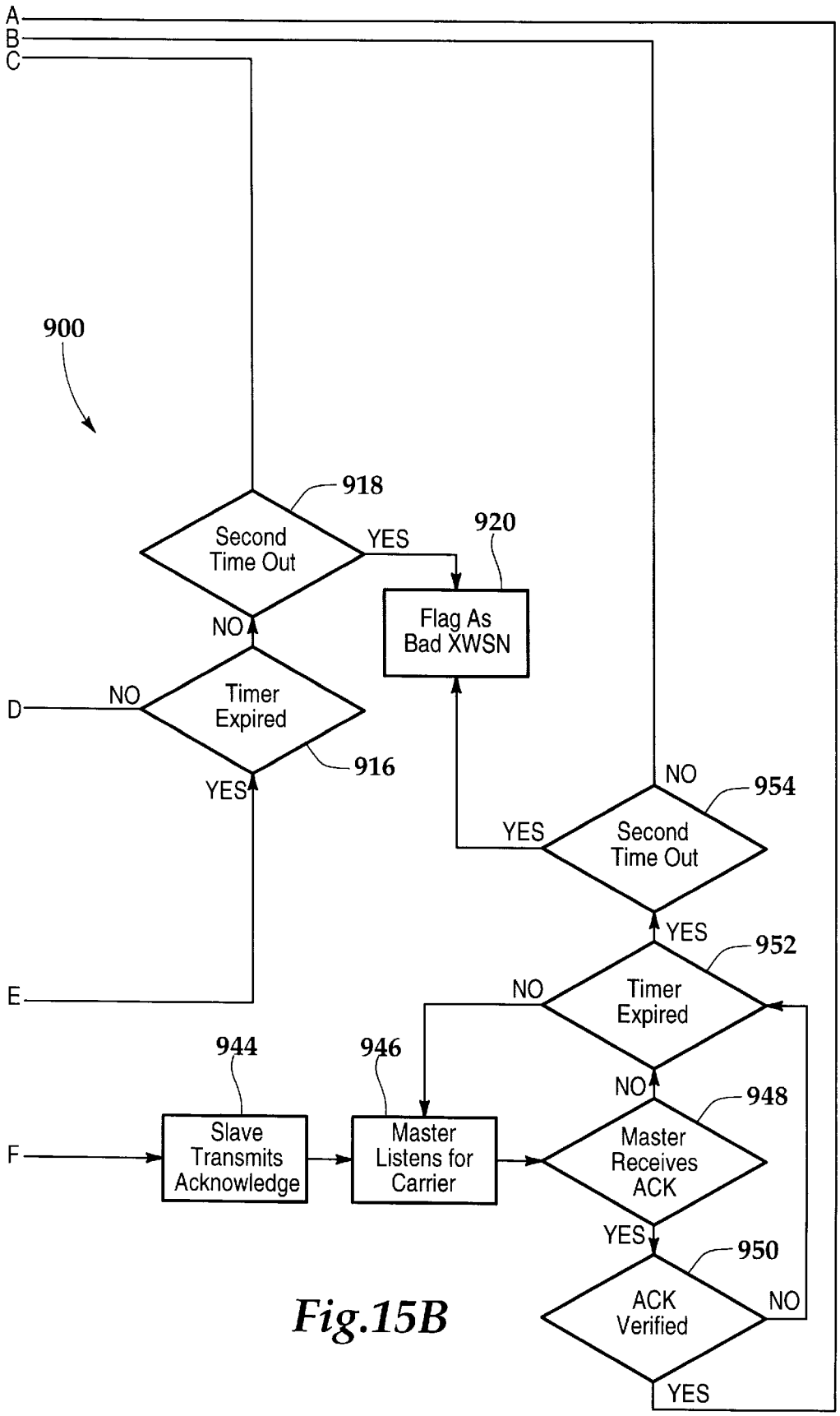

In FIGS. 15A–15B, a method for operating an electromagnetic telemetry system of the present invention is shown in a block diagram generally designated 900. For convenience of illustration the discussion will describe the interaction of the master sonde and slave sonde without reference to the repeaters. The method begins with the generation of a command signal 902 by surface installation 81. When the command signal 902 is generated, a timer 904 is set. If the command signal 902 is a new message 906, surface installation 81 initiates the transmission of command signal 902 in step 908. If command signal 902 is not a new message, it must be acknowledged in step 907 prior to being transmitted in step 908.

Transmission 908 involves sending the command signal 902 to the master sonde via electrical wire 82 and generating electromagnetic waves by the master sonde. Slave sondes listen for the command signal 902 in step 910. When a command message 902 is received by a slave sonde in step 912, the command signal 902 is verified in step 914 as described above with reference to FIG. 14. If the slave sonde is unable to verify the command signal 902, and the timer has not expired in step 916, the slave sonde will continue to listen for the command signal in step 910. If the timer has expired in step 916, and a second time out occurs in step 918, the command signal is flagged as a bad transmission in step 920.

If the command signal 902 is requesting a change in the operational state of a downhole device, a driver signal is generated in step 922 such that the operational state of the downhole device is changed in step 924. Once the operational state of the downhole device has been changed, the slave sonde receives a verification signal from the downhole device in step 926. If the verification signal is not received, the slave sonde will again attempt to change the operational state of the downhole device in step 924. If a verification signal is not received after the second attempt to change the operational state of the downhole device, in step 928, a message is generated indicating that there has been a failure to change the operational state of the downhole device.

The status of the downhole device, whether operationally changed or not, is then transmitted by the slave sonde in step 930. The master sonde listens for the carrier in step 932 and receives the status signal in step 934, which is verified by the surface installation in step 936. If the master sonde does not receive the status message in step 934, the master sonde continues to listen for a carrier in step 932. If the timer has expired in step 938, and a second time out has occurred in step 940, the transmission is flagged as a bad transmission in step 942. Also, if the surface installation is unable to verify the status of the downhole device in step 936, the master sonde will continue to listen for a carrier in step 932. If the timers in steps 938, 940 have expired, however, the transmission will be flagged as a bad transmission in step 942.

In addition, the method of the present invention includes a check back before operate loop which may be used prior to the actuation of a downhole device. In this case, command message 902 will not change the operational state of a downhole device, in step 922, rather slave sonde will simply acknowledge the command signal 902 in step 944. The master sonde will listen for a carrier in step 946, receive the acknowledgment in step 948 and forward the acknowledgment to the surface installation for verification in step 950. If the master sonde does not receive the acknowledgment in step 948, the master sonde will continue to listen for a carrier in step 946. If the timers have expired in steps 952, 954, the transmission will be flagged as a bad transmission in step 920. Additionally, if the surface installation is unable to verify the acknowledgment in step 950, the master sonde will continue to listen for a carrier in step 946. If the timers in step 952 and step 954 have timed out, however, the transmission will be flagged as a bad transmission in step 920.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An electromagnetic telemetry system for changing the operational state of a downhole device, the system comprising:

an electromagnetic transmitter disposed in a first wellbore transmitting a command signal;

an electromagnetic repeater disposed in a second wellbore receiving and retransmitting the command signal; and an electromagnetic receiver disposed in a third wellbore that is remote from the first wellbore, the electromagnetic receiver operably connected to the downhole device such that the command signal received from the electromagnetic repeater by the electromagnetic receiver is used to prompt the downhole device to change operational states.

2. The system as recited in claim 1 further comprising a surface installation for transmitting the command signal to the electromagnetic transmitter.

3. The system as recited in claim 2 further comprising an electrical wire electrically connecting the surface installation to the electromagnetic transmitter.

4. The system as recited in claim 1 wherein the electromagnetic transmitter further comprises a magnetically permeable annular core, a plurality of primary electrical conductor windings wrapped axially around the annular core and a plurality of secondary electrical conductor windings wrapped axially around the annular core.

5. The system as recited in claim 1 wherein the electromagnetic repeater further comprises a magnetically permeable annular core, a plurality of primary electrical conductor windings wrapped axially around the annular core and a plurality of secondary electrical conductor windings wrapped axially around the annular core.

6. The system as recited in claim 1 wherein the electromagnetic receiver further comprises a magnetically permeable annular core, a plurality of primary electrical conductor windings wrapped axially around the annular core and a plurality of secondary electrical conductor windings wrapped axially around the annular core.

7. The system as recited in claim 1 further comprising an electromagnetic transmitter disposed in the third wellbore transmitting a verification signal.

8. The system as recited in claim 7 further comprising an electromagnetic receiver disposed in the first wellbore receiving the verification signal.

9. The system as recited in claim 1 wherein the command signal further comprises a command sequence uniquely associated with the downhole device.

10. The system as recited in claim 9 wherein an electronics package associated with the electromagnetic receiver determines whether the command sequence is uniquely associated with the downhole device.

11. A downhole telemetry system for communicating a signal between a first wellbore and a remote wellbore, the system comprising:

a first communication device disposed in the first wellbore, the first communication device transmitting the signal;

a second communication device disposed in a second wellbore, the second communication device communicably linked to the first communication device to receive and retransmit the signal; and a third communication device disposed in the remote wellbore, the third communication device communicably linked to the second communication device, the third communication device receiving the signal from the second communication device.

12. The system as recited in claim 11 wherein the first communication device further includes an electromagnetic transmitter for transmitting electromagnetic waves and an electromagnetic receiver for receiving electromagnetic waves.

13. The system as recited in claim 11 wherein the first communication device further includes an electromagnetic transceiver for transmitting and receiving electromagnetic waves.

14. The system as recited in claim 11 wherein the second communication device further includes an electromagnetic transmitter for transmitting electromagnetic waves and an electromagnetic receiver for receiving electromagnetic waves.

15. The system as recited in claim 11 wherein the second communication device further includes an electromagnetic transceiver for transmitting and receiving electromagnetic waves.

16. The system as recited in claim 11 wherein the third communication device further includes an electromagnetic transmitter for transmitting electromagnetic waves and an electromagnetic receiver for receiving electromagnetic waves.

17. The system as recited in claim 11 wherein the third communication device further includes an electromagnetic transceiver for transmitting and receiving electromagnetic waves.

18. The system as recited in claim 11 wherein the third communication device generates a signal for transmission to the first communication device.

19. The system as recited in claim 11 wherein the signal is transmitted between a surface installation and the first communication device via an electrical wire.

20. The system as recited in claim 11 wherein the signal further comprises a command sequence uniquely associated with a downhole device.

21. A method of changing the operational state of a downhole device comprising the steps of:

transmitting a command signal from an electromagnetic transmitter disposed in a first wellbore;

receiving the command signal at an electromagnetic repeater disposed in a second wellbore;

retransmitting the command signal from the electromagnetic repeater;

receiving the command signal at an electromagnetic receiver disposed in a third wellbore that is remote from the first wellbore;

generating a driver signal in response to the command signal; and changing the operational state of the downhole device.

22. The method as recited in claim 21 further comprising the step of transmitting the command signal from a surface installation to the electromagnetic transmitter.

23. The method as recited in claim 22 wherein the step of transmitting the command signal from a surface installation to the electromagnetic transmitter further comprises transmitting the command signal via an electrical wire.

24. The method as recited in claim 21 further comprising the step of transmitting a verification signal from an electromagnetic transmitter disposed in the third wellbore.

25. The method as recited in claim 24 further comprising the step of receiving the verification signal at an electromagnetic receiver disposed in the first wellbore.

26. The method as recited in claim 25 further comprising the steps of receiving the verification signal at the electromagnetic repeater and retransmitting the verification signal.

27. The method as recited in claim 25 further comprising the step of transmitting the verification signal from the electromagnetic receiver disposed in the first wellbore to a surface installation.

28. The method as recited in claim 21 wherein the step of transmitting a command signal from an electromagnetic transmitter further comprises transmitting a command signal uniquely associated with the downhole device.

29. The method as recited in claim 28 further comprising the step of determining whether the command signal is uniquely associated with the downhole device.

30. A method of transmitting signals between a first wellbore and a remote wellbore comprising the steps of:

transmitting a signal from a transmitter disposed in the first wellbore;

receiving the signal at a repeater disposed in a second wellbore;

retransmitting the signal from the repeater; and receiving the signal at a receiver disposed in the remote wellbore.

31. The method as recited in claim 30 further comprising the step of transmitting the signal from a surface installation to the transmitter.

32. The method as recited in claim 30 further comprises transmitting the signal from the transmitter to the repeater via electromagnetic waves.

33. The method as recited in claim 30 further comprises transmitting the signal from the repeater to the receiver via electromagnetic waves.

34. The method as recited in claim 30 further comprising the step of transmitting a verification signal from a transmitter disposed in the remote wellbore.

35. The method as recited in claim 34 further comprising the step of receiving the verification signal at a receiver disposed in the first wellbore.

36. The method as recited in claim 35 further comprising the steps of receiving the verification signal at the repeater and retransmitting the verification signal.

37. A method of transmitting signals throughout a hydrocarbon field comprising the steps of:

transmitting a signal from a transmitter disposed in a first wellbore;

receiving the signal with a first stage one repeater disposed in a second wellbore;

retransmitting the signal from the first stage one repeater; and receiving the signal at a receiver disposed in a remote wellbore.

38. The method as recited in claim 37 further comprising the steps of receiving the signal with a second stage one repeater disposed in a third wellbore and retransmitting the signal from the second stage one repeater.

39. The method as recited in claim 37 further comprising the steps of receiving the signal with a plurality of stage one repeaters and retransmitting the signal from the plurality of stage one repeaters.

40. The method as recited in claim 37 further comprises the steps of receiving the signal with a first stage two repeater disposed in a third wellbore and retransmitting the signal from the first stage two repeater.

41. The method as recited in claim 40 further comprises the steps of receiving the signal with a second stage two repeater disposed in a fourth wellbore and retransmitting the signal from the second stage two repeater.

42. The method as recited in claim 40 further comprising the steps of receiving the signal with a plurality of stage two repeaters and retransmitting the signal from the plurality of stage two repeaters.

* * * * *